US012123299B2

(12) United States Patent
Li et al.

(10) Patent No.: US 12,123,299 B2
(45) Date of Patent: Oct. 22, 2024

(54) QUANTITATIVE HYDRAULIC FRACTURING SURVEILLANCE FROM FIBER OPTIC SENSING USING MACHINE LEARNING

(71) Applicant: Saudi Arabian Oil Company, Dhahran (SA)

(72) Inventors: Weichang Li, Katy, TX (US); Frode Hveding, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 35 days.

(21) Appl. No.: 17/900,542

(22) Filed: Aug. 31, 2022

(65) Prior Publication Data

US 2023/0071743 A1 Mar. 9, 2023

Related U.S. Application Data

(60) Provisional application No. 63/239,014, filed on Aug. 31, 2021.

(51) Int. Cl.
*E21B 47/12* (2012.01)
*E21B 43/26* (2006.01)

(52) U.S. Cl.
CPC ..... *E21B 47/138* (2020.05); *E21B 43/26* (2013.01); *E21B 2200/22* (2020.05)

(58) Field of Classification Search
CPC ..... E21B 47/12; E21B 47/135; E21B 47/138; E21B 43/26; E21B 2200/22
See application file for complete search history.

(56) References Cited

U.S. PATENT DOCUMENTS

| | | | |
|---|---|---|---|
| 2,305,384 | A | 12/1942 | Hoover, Jr. |
| 2,641,922 | A | 6/1953 | Smith |
| 2,978,673 | A | 4/1961 | Richard |
| 3,014,551 | A | 12/1961 | Chapanis |
| 3,196,385 | A | 7/1965 | Smith |
| 3,281,774 | A | 10/1966 | Warren |
| 3,719,924 | A | 3/1973 | Muir et al. |
| 4,051,372 | A | 9/1977 | Aine |

(Continued)

FOREIGN PATENT DOCUMENTS

| | | |
|---|---|---|
| CN | 102053270 | 5/2011 |
| CN | 102707314 | 10/2012 |

(Continued)

OTHER PUBLICATIONS

U.S. Appl. No. 17/237,746, filed Apr. 22, 2021, Colombo et al.

(Continued)

*Primary Examiner* — Franklin D Balseca
(74) *Attorney, Agent, or Firm* — Fish & Richardson P.C.

(57) ABSTRACT

A system and methods for quantitative hydraulic fracturing surveillance from fiber optic sensing using machine learning is described herein. An exemplary method provides capturing distributed acoustic sensing (DAS) data, distributed temperature sensing (DTS) data, and microseismic data over monitored stages. Operation states and variables at a respective stage are predicted, based on, at least in part, the DAS data, DTS data, or microseismic data. At least one event associated with the predicted operation states and variables is localized at the respective stage.

17 Claims, 17 Drawing Sheets

(56) References Cited

U.S. PATENT DOCUMENTS 4,208,732 A 6/1980 Ruehle
4,542,648 A 9/1985 Vinegar et al.
4,783,751 A 11/1988 Ehrlich
4,868,883 A 9/1989 Chen
4,969,129 A 11/1990 Currie et al.
5,010,776 A 4/1991 Lucero et al.
5,181,171 A 1/1993 McCormack et al.
5,191,557 A 3/1993 Rector et al.
5,287,328 A 2/1994 Anderson et al.
5,410,252 A 4/1995 Potter et al.
5,475,589 A 12/1995 Armitage et al.
5,663,499 A 9/1997 Semmelbeck et al.
5,844,799 A 12/1998 Joseph et al.
5,884,229 A 3/1999 Matteucci
6,088,656 A 7/2000 Ramakrishnan et al.
6,205,402 B1 3/2001 Lazaar et al.
6,226,596 B1 5/2001 Gao
6,246,963 B1 6/2001 Cross et al.
6,438,493 B1 8/2002 West et al.
6,480,790 B1 11/2002 Calvert
6,574,565 B1 6/2003 Bush
6,597,446 B2 7/2003 Klooster et al.
6,640,898 B2 11/2003 Lord et al.
6,754,588 B2 6/2004 Cross et al.
6,775,619 B2 8/2004 Nyland
6,980,940 B1 12/2005 Gurpinar et al.
6,982,928 B2 1/2006 Al-Ali
7,043,367 B2 5/2006 Granjeon
7,317,989 B2 1/2008 DiFoggio
7,337,069 B2 2/2008 Masson et al.
7,363,158 B2 4/2008 Stelting et al.
7,387,021 B2 6/2008 DiFoggio
7,424,367 B2 9/2008 Saltzer et al.
7,520,158 B2 4/2009 DiFoggio
7,616,524 B1 11/2009 Gersztenkorn
7,719,676 B2 5/2010 DiFoggio
7,857,055 B2 12/2010 Li
7,908,230 B2 3/2011 Bailey et al.
7,925,481 B2 4/2011 Van Wagoner et al.
7,970,545 B2 6/2011 Sanstrom
8,081,796 B2 12/2011 Derzhi et al.
8,098,376 B2 1/2012 So et al.
8,170,799 B2 5/2012 Dvorkin et al.
8,184,502 B2 5/2012 Xu et al.
8,204,727 B2 6/2012 Dean et al.
8,219,322 B2 7/2012 Monsen
8,234,923 B2 8/2012 Ramamurthy et al.
8,334,980 B2 12/2012 So et al.
8,335,677 B2 12/2012 Yeten et al.
8,359,904 B2 1/2013 Nicoletti et al.
8,380,642 B2 2/2013 Stundner et al.
8,385,604 B2 2/2013 Orpen
8,473,213 B2 6/2013 Zhu et al.
8,476,016 B2 7/2013 Ashby
8,510,242 B2 8/2013 Al-Fattah et al.
8,548,785 B2 10/2013 Chugunov et al.
8,583,410 B2 11/2013 Sisk et al.
8,605,951 B2 12/2013 Baggs et al.
8,612,195 B2 12/2013 Sun et al.
8,676,557 B2 3/2014 Ding et al.
8,714,246 B2 5/2014 Pop et al.
8,793,111 B2 7/2014 Tilke et al.
8,826,973 B2 9/2014 Moxley et al.
8,838,425 B2 9/2014 Zhang et al.
8,849,623 B2 9/2014 Carvallo et al.
8,938,045 B2 1/2015 Dvorkin et al.
9,043,188 B2 5/2015 Yeten et al.
9,043,189 B2 5/2015 Wallace et al.
9,046,509 B2 6/2015 Dvorkin et al.
9,047,513 B2 6/2015 Derzhi et al.
9,085,957 B2 7/2015 Wallace et al.
9,091,161 B2 7/2015 Brannon
9,121,971 B2 9/2015 Thorne
9,201,026 B2 12/2015 Walls et al.
9,262,713 B2 2/2016 Shelley et al.
9,372,943 B2 6/2016 Li et al.
9,612,231 B2 4/2017 Pottorf et al.
9,626,771 B2 4/2017 Mezghani et al.
9,696,283 B1 7/2017 Yu
9,703,006 B2 7/2017 Stern et al.
9,810,062 B2 11/2017 Akkurt et al.
10,012,758 B2 7/2018 Speck et al.
10,067,255 B2 9/2018 Colombo et al.
10,295,685 B2 5/2019 Zhang et al.
10,345,468 B2 7/2019 Poole
10,386,519 B2 8/2019 Colombo et al.
10,845,494 B2 11/2020 Zhao et al.
10,852,450 B2 12/2020 Colombo et al.
10,891,462 B2 1/2021 Zhao
10,920,585 B2 2/2021 Colombo et al.
10,934,839 B2 3/2021 AbuAli et al.
10,982,537 B2 4/2021 AbuAli et al.
10,983,235 B2 4/2021 Zhang et al.
10,991,078 B2 4/2021 Hakimuddin
11,010,883 B2 5/2021 Anifowose et al.
11,092,709 B2 8/2021 Zhao et al.
11,243,322 B2 2/2022 Li
11,753,918 B2 * 9/2023 Bannikov ..... E21B 47/06 166/250.1
11,879,317 B2 * 1/2024 Hunter ..... G01V 1/42
2002/0042677 A1 4/2002 West
2002/0177955 A1 11/2002 Jalali et al.
2003/0024738 A1 2/2003 Schuh
2003/0044061 A1 3/2003 Prempraneerach
2003/0110018 A1 6/2003 Dutta et al.
2003/0200030 A1 10/2003 Meldahl
2005/0177349 A1 8/2005 Lu
2006/0012785 A1 1/2006 Funk et al.
2006/0266108 A1 11/2006 DiFoggio
2006/0266109 A1 11/2006 Difoggio
2007/0016389 A1 1/2007 Ozgen
2007/0061079 A1 3/2007 Hu
2007/0064531 A1 3/2007 DuBose
2007/0133866 A1 6/2007 Chang et al.
2007/0239359 A1 10/2007 Stelting et al.
2008/0111064 A1 5/2008 Andrews et al.
2008/0175478 A1 7/2008 Wentland et al.
2008/0187219 A1 8/2008 Chen et al.
2009/0014181 A1 1/2009 Vinegar et al.
2009/0027677 A1 1/2009 Willing et al.
2009/0164186 A1 6/2009 Haase et al.
2009/0204377 A1 8/2009 Van Wagoner et al.
2009/0259446 A1 10/2009 Zhang et al.
2009/0288881 A1 11/2009 Mullins et al.
2010/0011836 A1 1/2010 Kalkman
2010/0044103 A1 2/2010 Moxley et al.
2010/0057409 A1 3/2010 Jones et al.
2010/0198638 A1 8/2010 Deffenbaugh et al.
2010/0219334 A1 9/2010 Legrand et al.
2010/0286967 A1 11/2010 Vasilevskiy
2010/0305927 A1 12/2010 Suarez-Rivera et al.
2010/0312529 A1 12/2010 Souche
2011/0011595 A1 1/2011 Huang et al.
2011/0048731 A1 3/2011 Imhof et al.
2011/0054869 A1 3/2011 Li et al.
2011/0069581 A1 3/2011 Krohn
2011/0072886 A1 3/2011 Caneau
2011/0088895 A1 4/2011 Pop et al.
2011/0103184 A1 5/2011 Westeng et al.
2011/0191080 A1 8/2011 Klie
2011/0213556 A1 9/2011 Yu et al.
2011/0218950 A1 9/2011 Mirowski
2011/0251797 A1 10/2011 Leger et al.
2011/0295580 A1 12/2011 Sisk
2012/0048618 A1 3/2012 Zamanian et al.
2012/0150510 A1 6/2012 Safonov et al.
2012/0151994 A1 6/2012 Hung
2012/0158389 A1 6/2012 Wu et al.
2012/0210796 A1 8/2012 Schade
2012/0221306 A1 8/2012 Hurley et al.
2012/0253770 A1 10/2012 Stern et al.
2012/0261135 A1 10/2012 Nowak et al.
2012/0275658 A1 11/2012 Hurley et al.
2012/0277996 A1 11/2012 Hurley et al.

(56) References Cited

U.S. PATENT DOCUMENTS

| | | | |
|---|---|---|---|
| 2012/0281883 | A1 | 11/2012 | Hurley et al. |
| 2013/0013209 | A1 | 1/2013 | Zhu et al. |
| 2013/0028051 | A1 | 1/2013 | Barkved et al. |
| 2013/0033961 | A1 | 2/2013 | Burnstad |
| 2013/0064040 | A1 | 3/2013 | Imhof et al. |
| 2013/0080133 | A1 | 3/2013 | Sung et al. |
| 2013/0092662 | A1 | 4/2013 | Fukami et al. |
| 2013/0140031 | A1 | 6/2013 | Cohen et al. |
| 2013/0194893 | A1 | 8/2013 | Nagarajappa |
| 2013/0266039 | A1 | 10/2013 | Legrand et al. |
| 2013/0297272 | A1 | 11/2013 | Sung et al. |
| 2013/0297273 | A1 | 11/2013 | Altundas et al. |
| 2013/0301672 | A1 | 11/2013 | Tonina |
| 2013/0304679 | A1 | 11/2013 | Fleming |
| 2013/0327125 | A1 | 12/2013 | He |
| 2013/0336091 | A1 | 12/2013 | Song et al. |
| 2014/0114627 | A1 | 4/2014 | Jones et al. |
| 2014/0138528 | A1 | 5/2014 | Pope et al. |
| 2014/0195215 | A1 | 7/2014 | Chen et al. |
| 2014/0214387 | A1 | 7/2014 | Tilke |
| 2014/0240951 | A1 | 8/2014 | Brady et al. |
| 2014/0288838 | A1 | 9/2014 | Trickett |
| 2014/0303951 | A1 | 10/2014 | Houeto et al. |
| 2014/0365135 | A1 | 12/2014 | Poole |
| 2014/0378319 | A1 | 12/2014 | Regberg et al. |
| 2015/0073715 | A1 | 3/2015 | Aarre |
| 2015/0081265 | A1 | 3/2015 | Kauerauf et al. |
| 2015/0127261 | A1 | 5/2015 | Aldea et al. |
| 2015/0129147 | A1 | 5/2015 | Sumnicht et al. |
| 2015/0153476 | A1 | 6/2015 | Prange et al. |
| 2015/0233233 | A1 | 8/2015 | Rahman |
| 2015/0234863 | A1 | 8/2015 | Lilje |
| 2015/0241591 | A1 | 8/2015 | Burmester et al. |
| 2015/0293257 | A1 | 10/2015 | Liebich et al. |
| 2015/0310294 | A1 | 10/2015 | Keskes et al. |
| 2015/0316674 | A1 | 11/2015 | Deschizeaux et al. |
| 2015/0369029 | A1 | 12/2015 | Potapenko |
| 2016/0018985 | A1 | 1/2016 | Bennet et al. |
| 2016/0040518 | A1 | 2/2016 | Potapenko |
| 2016/0054285 | A1 | 2/2016 | Freese |
| 2016/0070024 | A1 | 3/2016 | Berard et al. |
| 2016/0109593 | A1 | 4/2016 | Saxena et al. |
| 2016/0139085 | A1 | 5/2016 | Pelletier et al. |
| 2016/0146973 | A1 | 5/2016 | Johnson et al. |
| 2016/0161635 | A1 | 6/2016 | Ramsay et al. |
| 2016/0187513 | A1 | 6/2016 | Poole et al. |
| 2016/0290132 | A1 | 10/2016 | Knight et al. |
| 2016/0307312 | A1 | 10/2016 | Sungkorn et al. |
| 2016/0313463 | A1 | 10/2016 | Wahrmund et al. |
| 2016/0320509 | A1 | 11/2016 | Almuhaidib |
| 2016/0341707 | A1 | 11/2016 | Inan |
| 2016/0341834 | A1 | 11/2016 | Bartetzko |
| 2016/0343150 | A1 | 11/2016 | Mezghani et al. |
| 2017/0011149 | A1 | 1/2017 | Liu et al. |
| 2017/0030819 | A1 | 2/2017 | Mccarty et al. |
| 2017/0038294 | A1 | 2/2017 | Kshirsagar |
| 2017/0091636 | A1 | 3/2017 | Polyakov |
| 2017/0091958 | A1 | 3/2017 | Mezghani et al. |
| 2017/0137699 | A1 | 5/2017 | Song et al. |
| 2017/0193361 | A1 | 7/2017 | Chilimbi et al. |
| 2017/0205531 | A1 | 7/2017 | Berard et al. |
| 2017/0211372 | A1 | 7/2017 | Samuel |
| 2017/0241251 | A1 | 8/2017 | Rodrigues et al. |
| 2017/0260855 | A1 | 9/2017 | Yang et al. |
| 2017/0337302 | A1 | 11/2017 | Mezghani et al. |
| 2017/0370197 | A1 | 12/2017 | Han et al. |
| 2018/0003691 | A1 | 1/2018 | N'Guessan et al. |
| 2018/0136353 | A1 | 5/2018 | Zhao et al. |
| 2018/0156600 | A1 | 6/2018 | Cable et al. |
| 2018/0321405 | A1 | 11/2018 | Colombo et al. |
| 2018/0355707 | A1 | 12/2018 | Herrera et al. |
| 2018/0364381 | A1 | 12/2018 | Raterman et al. |
| 2019/0078427 | A1 | 3/2019 | Gillan |
| 2019/0169986 | A1 | 6/2019 | Storm et al. |
| 2019/0179043 | A1 | 6/2019 | Qin et al. |
| 2019/0271793 | A1 | 9/2019 | Wilson et al. |
| 2019/0353812 | A1 | 11/2019 | Zhang et al. |
| 2019/0353813 | A1 | 11/2019 | Cobos et al. |
| 2020/0040717 | A1 | 2/2020 | Feng et al. |
| 2020/0063532 | A1 | 2/2020 | Crouse et al. |
| 2020/0134773 | A1 | 4/2020 | Pinter et al. |
| 2020/0319108 | A1 | 10/2020 | Butte et al. |
| 2020/0386080 | A1 | 12/2020 | Xu |
| 2021/0095557 | A1 | 4/2021 | Xu et al. |
| 2021/0131254 | A1 | 5/2021 | Potty et al. |
| 2021/0190983 | A1 | 6/2021 | Colombo et al. |
| 2021/0246784 | A1 | 8/2021 | AbuAli et al. |
| 2021/0264262 | A1 | 8/2021 | Colombo et al. |
| 2023/0184087 | A1 | 6/2023 | Lin et al. |
| 2023/0184107 | A1 | 6/2023 | Li et al. |
| 2023/0221460 | A1 | 7/2023 | Lin et al. |

FOREIGN PATENT DOCUMENTS

| | | |
|---|---|---|
| CN | 102749648 | 10/2012 |
| CN | 102854533 | 1/2013 |
| CN | 102998703 | 3/2013 |
| CN | 103645507 | 3/2014 |
| CN | 102425374 | 7/2014 |
| CN | 104376556 | 2/2015 |
| CN | 104483704 | 4/2015 |
| CN | 104914465 | 9/2015 |
| CN | 105247546 | 1/2016 |
| CN | 107356958 | 11/2017 |
| EP | 2772775 | 9/2014 |
| JP | 2007527157 | 9/2007 |
| RU | 2270907 | 2/2006 |
| WO | WO 0229445 | 4/2002 |
| WO | WO 2005078601 | 8/2005 |
| WO | WO 2005119303 | 12/2005 |
| WO | WO 2008048697 | 4/2008 |
| WO | WO 2009024544 | 2/2009 |
| WO | WO 2009139949 | 11/2009 |
| WO | WO 2012118866 | 9/2012 |
| WO | WO 2012118868 | 9/2012 |
| WO | WO 2013071185 | 5/2013 |
| WO | WO 2013092662 | 6/2013 |
| WO | WO 2013092663 | 6/2013 |
| WO | WO 2013149126 | 10/2013 |
| WO | WO 2014114683 | 7/2014 |
| WO | WO 2015078842 | 6/2015 |
| WO | WO 2015127349 | 8/2015 |
| WO | WO 2015192239 | 12/2015 |
| WO | WO 2016003985 | 1/2016 |
| WO | WO 2016012826 | 1/2016 |
| WO | WO 2016195846 | 12/2016 |
| WO | WO 2017011658 | 1/2017 |
| WO | WO 2017172935 | 10/2017 |
| WO | WO 2017197203 | 11/2017 |
| WO | WO 2018204920 | 11/2018 |
| WO | WO 2018208634 | 11/2018 |
| WO | WO 2019222129 | 11/2019 |
| WO | WO 2020040829 | 2/2020 |
| WO | WO 2020089670 | 5/2020 |

OTHER PUBLICATIONS

U.S. Appl. No. 13/695,226, filed Apr. 22, 2011, Imhof et al.

PCT International Search Report and Written Opinion in International Appln. No. PCT/US2022/075782, dated Nov. 30, 2022, 15 pages.

Aboaba, "Machine Learning Based Real-Time Quantification of Production from Individual Clusters in Shale Wells," Graduate Theses, Dissertations, and Problem Reports. 11269, 2022, 83 pages.

Abouelresh, "Quantitative and Qualitative Evaluation of Micro-Porosity in Qusaiba Hot Shale, Saudi Arabia", 3rd Unconventional Resources Technology Conference, Jul. 2015, 10 pages.

Abu-Ali et al., "Paleozoic petroleum systems of Saudi Arabia: a basin modeling approach," Geo Arabia, vol. 10, No. 3, published 2005; pp. 131-168.

Abukhamsin, "Inflow Profiling and Production Optimization in Smart Wells Using Distributed Acoustic and Temperature Measurements," Thesis at: Stanford University, Aug. 2016.

(56) References Cited

OTHER PUBLICATIONS

Ahmadi et al., "Comparison of machine learning methods for estimating permeability and porosity of oil reservoirs via petrophysical logs," Petroleum, 2019, 5:271-284, 14 pages.
Akinade et al., "Improving The Rheological Properties of Drilling Mud Using Local Based Materials," American Journal of Engineering Research, Jan. 2018, 7 pages.
Al Ibrahim and Mustafa, "Multi-scale sequence stratigraphy, cyclostratigraphy, and depositional environment of carbonate mudrocks in the Tuwaiq Mountain and Hanifa formations, Saudi Arabia," Diss. Colorado School of Mines, Arthur Lakes Library, 2014, 208 pages.
Alakeely et al., "Application of Artificial Intelligence for Fluid Typing using Calibrated Compositional Data", 11th Middle East Geosciences Conference and Exhibition (GEO 2014), Mar. 2014, 25 pages.
Al-Ali et al., "Vibrator Attribute Leading Velocity Estimation," The Leading Edge, May 2003, 5 pages.
Al-Bazzaz and Al-Mehanna, "Porosity, Permeability, MHR Calculations Using SEM and Thin-section Images for Characterizing Complex Mauddud-Burgan Carbonate Reservoir," Paper SPE-110730-MS, Society of Petroleum Engineers (SPE), presented at the Asia Pacific Oil and Gas Conference and Exhibition, Oct. 30-Nov. 1, 2007, 10 pages.
Alexandrov et al., "Improving imaging and repeatability on land using virtual source redatuming with shallow buried receivers," XPo55463335, Geophysics 8:2, Mar. 1, 2015, 12 pages.
Alexandrov et al., "Improving land seismic repeatability with virtual source redatuming: synthesis case study," Society of Exploration Geophysicists (SEG), presented at the SEG Las Vegas 2012 Annual Meeting, SEG Technical Program Expanded Abstracts 2012, 1-5, Sep. 2012, 5 pages.
Al-Hameedi et al., "Mud loss estimation using machine learning approach," Journal of Petroleum Exploration and Production Technology, Jun. 2019, 9:2 (1339-1354), 16 pages.
AlQattan et al., "Moving models into reality: an automated workflow to calibrate forward stratigraphic modeling; application to Hanifa and Arab-D in Central Saudi Arabia," presented at the Abu Dhabi International Petroleum Exhibition & Conference, Nov. 13-16, 2017; Society of Petroleum Engineers, 2017, 11 pages.
Alsaihati et al., "Real-Time Prediction of Equivalent Circulation Density for Horizontal Wells Using Intelligent Machines," American Chemical Society (ACS), ACS Omega., Jan. 2021, 6(1): 934-942, 9 pages.
Andrianov, "A machine learning approach for virtual flow metering and forecasting," IFAC PapersOnLine, 2018, 51:8 (191-196), 6 pages.
Anoop et al. "Viscosity measurement dataset for a water-based drilling mud-carbon nanotube suspension at high-pressure and high-temperature," Data in Brief., Jun. 2019, 24: 103816, 5 pages.
Anselmetti et al., "Quantitative characterization of carbonate pore systems by digital image analysis," AAPG Bulletin, vol. 82, No. 10, Oct. 1998, 22 pages.
Antony et al., "Photonics and fracture toughness of heterogeneous composite materials," 2017, Scientific Reports, 7:4539, 8 pages.
Askari and Siahkoohi, "Ground roll attenuation using the S and x-f-k transforms," Geophysical Prospecting 56, Jan. 2008, 10 pages.
Asmussen et al., "Semi-automatic Segmentation of Petrographic This Section Images using a "Seeded-Region Growing Algorithm" with an Application to Characterize Wheathered Subarkose Sandstone," Computers & Geosciences, 83:C, Oct. 2015, 11 pages.
Assous et al., "Microresistivity borehole image inpainting," Geophysics vol. 79 No. 2, Mar.-Apr. 2014, 9 pages.
Bakulin and Calvert, "The virtual source method: Theory and case study," Geophysics 71:4, Jul.-Aug. 2006, 12 pages.
Bakulin and Calvert, "Virtual Source: new method for imaging and 4D below complex overburden," Society of Exploration Geophysicists (SEG), presented at the SEG International Exposition and 74th Annual Meeting, Oct. 10-15, 2004, 4 pages.
Barraud, "The use of watershed segmentation and GIS software for textural analysis of thin sections," Journal of Volcanology and Geothermal Research, 154, Jun. 1, 2006, 17 pages.
Barton et al., "Interactive image analysis of borehole televiewer data. Automated pattern analysis in petroleum exploration," Springer New York, 1992; pp. 223-248.
Bartozzi et al., "Automated Grain Boundary Detection and Classification in Orientation Contrast Images," Journal of Structural Geology, 2000, 1569-1579.
Batarseh et al., "Downhole high-power laser tools development and evolutions," presented at the Abu Dhabi International Petroleum & Exhibition Conference, Abu Dhabi, United Arab Emirates, Nov. 12-15, 2018, 15 pages.
Batarseh et al., "High power laser application in openhole multiple fracturing with an overview of laser research; Past, present and future," Society of Petroleum Engineers (SPE), presented at the SPE Saudi Arabia Section Technical Symposium and Exhibition, Khobar, Saudi Arabia, Apr. 8-11, 2012, 10 pages.
Batarseh et al., "Laser Gun: The Next Perforation Technology," Society of Petroleum Engineers (SPE), presented at the SPE Middle East Oil & Gas Show and Conference, Manama, Bahrain, Mar. 18-21, 2019, 15 pages.
Batarseh et al., "Microwave With Assisted Ceramic Materials to Maximize Heat Penetration and Improve Recovery Efficiency of Heavy Oil Reservoirs," Society of Petroleum Engineers (SPE), presented at the SPE Middle East Oil & Gas Show and Conference, Kingdom of Bahrain, Mar. 6-9, 2017, 24 pages.
Batarseh et al., "Well Perforation Using High-Power Lasers," Society of Petroleum Engineers (SPE), presented at the SPE Annual Technical Conference and Exhibition, Denver, Colorado, Oct. 5-8, 2003, 10 pages.
Beck et al., "The Effect of Rheology on Rate of Penetration," SPE/IADC 29368, Society of Petroleum Engineers (SPE), Drilling Conference., Jan. 1995, 9 pages.
Beda et al., "An Innovative Approach for Estimating the Sw and Porosity Using Gas and Mud Logging Data in Real Time", AAPG International Conference and Exhibition, Oct. 31, 2011, 17 pages.
Beda et al., "Gas While Drilling (GWD); A Real Time Geologic And Reservoir Interpretation Tool", SPWLA 40th Annual Logging Symposium, 1999, 14 pages.
Bég et al., "Experimental study of improved rheology and lubricity of drilling fluids enhanced with nano-particles," Applied Nanoscience., Jun. 2018, 8(5): 1069-1090, 22 pages.
Benedet et al., "A morphological modeling study to compare different methods of wave climate schematization and evaluate strategies to reduce erosion losses from a beach nourishment project," Coastal Engineering, 112, Jun. 2016, 18 pages.
Benedet et al., "Optimization of nearshore dredge pit design to reduce impacts on adjacent beaches," Journal of Coastal Research 29:3, May 2013, 8 pages.
Bennetzen et al., "Automatic High-Throughput Detection of Fluid Inclusions in Thin-Section Images using a Novel Algorithm," Paper IPTC-17680 presented at the International Petroleum Technology Conference, Jan. 19-22, 2014, 11 pages.
Berrezueta et al. "Qualitative and quantitative changes in detrital reservoir rocks caused by CO2—brine—rock interations during first injection phases (Utrillas sanstones, northern Spain)," Solid Earth 7, Jan. 2016, 17 pages.
Bikmukhametov et al., "Combining machine learning and process engineering physics towards enhanced accuracy and explainability of data-driven models," Computers and Chemical Engineering, Jul. 2020, 138:106834, 27 pages.
Bikmukhametov et al., "First principles and machine learning virtual flow metering: A literature review," Journal of Petroleum Science and Engineering, Jan. 2020, 184:106487, 26 pages.
Blair and Berryman, "Estimation of Permeability and Relative Permeability for Sandstone using Image Analysis of Cross Sections" Rock Mechanics as a Multidisciplinary Science, Roegiers (ed.), Mar. 1991, 12 pages.
Boinott et al., "High resolution geomechanical profiling in heterogeneous source rock from the Vaca Muerta Formation, Neuquén Basin, Argentina," presented at the 52nd US Rock Mechanics/

(56) References Cited

OTHER PUBLICATIONS

Geomechanics Symposium, Seattle, Washington, USA, American Rock Mechanics Association, Jun. 17-20, 2018, 8 pages.
Born et al., "Principles of Optics: Electromagnetic Theory of Propagation, Interference and Diffraction of Light," 6th ed. Pergamon Press, 808 pages.
Bornholdt et al., "Experiments in Stratigraphy: Recent Advances in Stratigraphic and Sedimentologic Computer Simulators—Inverse stratigraphic modeling using genetic algorithms," SEPM Publication, Society of Sedimentary Geology, 62, Jan. 1, 1999, 6 pages.
Bornholdt et al., "Inverse Stratigraphic Modeling Using Genetic Algorithms: Introduction," Society for Sedimentary Geology (SEPM), Jan. 1, 1999, 1 page.
Brown and Davies, "Methods for medium-term prediction of the net sediment transport by waves and currents in complex coastal regions," Continental Shelf Research, 29, Jun. 2009, 13 pages.
Buscombe, "Estimation of Grain-Size Distributions and Associated Parameters from Digital Images of Sediment," Sedimentary Geology, 2008, 1-10.
Cadzou, "Signal enhancement—A Composite Property Mapping Algorithm," Institute of Electrical and Electronics Engineers (IEEE), IEEE Transactions on Acoustics, Speech and Signal Processing, 36:1, Jan. 1988, 14 pages.
Caeiro et al., "Geostatistical Modeling of Complex Deltaic Reservoirs Integrating Production Data through Optimized History Matching," SPE 177813, Abu Dhabi International Petroleum Exhibition and Conference, Nov. 12, 2015, Abu Dhabi, UAE; 14 pages.
Cantrell et al., "New tools and approaches in carbonate reservoir quality prediction: a case history from the Shu'aiba Formation, Saudi Arabia," The Geological Society of London, Special Publications, Sep. 29, 2014, 25 pages.
Carpenter, "Distributed Acoustic Sensing for Downhole Production and Injection Profiling," Journal of Petroleum Technology., Mar. 2016, 68(03): 78-79, 2 pages.
Carvill, "Integration of an extensive uphole program with refraction analysis to build a 3-D near-surface model on a workstation: A case history," Society of Exploration Geophysicists (SEG), SEG Technical Program Expanded Abstracts, 1995, 4 pages.
Cazanacli et al., "Deltaic Network Growth and Stratigraphy through a Rule Based Geometric Model," AAPG 2015, Annual Convention and Exhibition, May 31-Jun. 3, 2015, 48 pages.
Chai et al., "Automatic discrimination of sedimentary facies and lithologies in reef-bank reservoirs using borehole image logs," Applied Geophysics, Mar. 2009, vol. 6, No. 1; pp. 17-29.
Chatzirodou et al., "Investigation of deep sea shelf sandbank dynamics driven by highly energetic tidal flows," Marine Geology, 380, Oct. 1, 2016, 19 pages.
Chen, "Application of Machine Learning Methods to Predict Well Productivity in Montney and Duvernay," University of Calgary, Apr. 2019, pages.
Chen, "Robust matrix rank reduction methods for seismic data processing," Thesis for the degree of Master of Science in Geophysics, University of Alberta, Fall of 2013, 136 pages.
Choh and Milliken, "Virtual Carbonate Thin Section using PDF: New Method for Interactive Visualization and Archiving," Carbonates and Evaporites, 19:2, Dec. 2004, 6 pages.
Choudhary and Mukerji, "Generation of Multiple History Matched Models Using Optimization Technique," 25th Annual SCRF Meeting, 2012, 61 pages.
Choudhury et al., "Automated Grain Boundary Detection by CASRG," Journal of Structural Geology, Mar. 1, 2006, 28:3 (363-375).
Christiawan et al., "Innovative Multi Technologies Collaboration for Ultra-HP/H Offshore Fracturing Stimulation," OTC-26663-MS, Offshore Technology Conference (OTC), presented at the Offshore Technology Conference Asia, Mar. 22-25, 2016, 26 pages.
Couprie et al., "Quasi-linear algorithms for the topological watershed," Journal of Mathematical Imagining and Vision, 22:2-3 (231-249), 2005.
Couprie et al., "Topological Gray-Scale Watershed Transform," in Proceedings of SPIE Vision Geometry V, 3168:136-146, 1997.
Cross and Lessenger, "Construction and application of a stratigraphic inverse model," SEPM Special Publications, 62, Jan. 1, 1999, 15 pages.
Cullick et al., "Improved and more-rapid history matching with a nonlinear proxy and global optimization," SPE 101933, SPE Annual Technical Conference and Exhibition, vol. 2, Sep. 24, 2006, San Antonio, TX; pp. 728-740.
cydarex.fr [online], "Cydarex: DarcyLog and DarcyPress," available on or before Feb. 28, 2021, via Internet Archive: Wayback Machine URL <http://web.archive.org/web/20210228224638/http://www.cydarex.fr?page_id=33>, retrieved on Feb. 3, 2022, URL <http://www.cydarex.fr/?page_id=33>.
Das, "Morphology-Based Image Processing, In: Guide to Signals and Patterns in Image Processing: Foundations," Methods and Applications, Springer, Apr. 23, 2015, p. 269-298, Abstract only, 3 pages.
Dashti et al., "Use of Mud Gas Chromatograph for Reservoir Quality Prediction While Drilling—A Case Study", SPE Kuwait Oil and Gas Show and Conference, 2015, 17 pages.
De Bruin and Bouanga, "Time attributes of Stratigraphic Surfaces, analyzed in the structural and Wheeler transformed domain," EAGE 69th Conference and Exhibition, Jun. 11-14, 2007, 5 pages.
DeVasto et al., "Using image Analysis and Arcgis to Improve Automatic Grain Boundary Detection and Quantify Geological Images," Computers and Geosciences, 49, Dec. 2012, 8 pages.
Dey, "Fluvial Hydrodynamics," GeoPlanet: Earth and Planetary Science, 2014, 706 pages.
Diallo et al., "Characterization of polarization attributes of seismic waves using continuous wavelet transforms," Geophysics 71:3, May-Jun. 2006, 12 pages.
DMT; "DMT CoreScan 3 High-Tech Core Logging Tool"; http://www.corescan.de/fileadmin/downloads/DMT_CoreScan3_Info.pdf; Jan. 31, 2013; pp. 1-20.
Douglas et al., "Methane clumped isotopes: Progress and potential for a new isotopic tracer," Organic Geochemistry 113, Nov. 2017, 21 pages.
Duan et al., "Similarity measure of sedimentary successions and its applications in inverse stratigraphic modeling," Petroleum Science, Jul. 2017, 14(3): 484-492.
Erofeev et al., "Prediction of Porosity and Permeability Alteration Based on Machine Learning Algorithms," Transport in Porous Media, Springer, 2019, 24 pages.
Erzinger et al., "Real-time mud gas logging during drilling of the SAFOD Pilot Hole in Parkfield, CA", Geophysical Research Letters, Jun. 24, 2004, 31, 4 pages.
Fan et al., "Well production forecasting based on ARIMA-LSTM model considering manual operations," Energy, Apr. 2021, 220:119708, 13 pages.
Feo et al., "Distributed Fiber Optic Sensing for Real-Time Monitoring of Gas in Riser during Offshore Drilling," Sensors, Jan. 2020. 20(1): 267, 16 pages.
Fontana et al., "Past, Present and Future Advancements in Methods for Detecting Hydrocarbon Seepage after 75 Years," copyright 2014, 49 pages.
Francus, "An Image-Analysis Technique to Measure Grain-Size Variation in Thin Sections of Soft Clastic Sediments," Sedimentary Geology 121, Nov. 1998, 10 pages.
Frank, "Discriminating between coherent and incoherent might with metasurfaces," Jul. 2018, 11 pages.
Fueten, "A Computer-Controlled Rotating Polarizer Stage for the Petrographic Microscope," Computers & Geosciences, 23:2 (203-208), Mar. 1, 1997.
Gaillot et al.; "Contribution of Borehole Digital Imagery in Core-Logic-Seismic Integration"; Scientific Drilling, No. 5; Sep. 2007, pp. 50-53.
Ghahfarokhi et al., "A Fiber-optic Assisted Multilayer Perceptron Reservoir Production Modeling: A Machine Learning Approach in Prediction of Gas Production from the Marcellus Shale," In Proceedings of the 6th Unconventional Resources Technology Conference. Houston, Texas, USA American Association of Petroleum Geologists, 2018, 10 pages.

(56) References Cited

OTHER PUBLICATIONS

Gholami et al., "Applications of artificial intelligence methods in prediction of permeability in hydrocarbon reservoirs," Journal of Petroleum Science and Engineering, Oct. 2014, 122:643-656, 14 pages.
Giboli et al., "Reverse time migration surface offset gathers part 1: a new method to produce classical common image gathers," SEG Technical Program Expanded Abstracts 2012, Sep. 1, 2012, 6 pages.
Gibson et al. "Apparent layering in common midpoint stacked images of two dimensionally heterogeneous targets," Geophysics vol. 55, Issue 11, Nov. 1990, 12 pages.
Gibson, "Analysis of lateral coherence in wide angle seismic images of heterogeneous targets," Journal of Geophysical Research, vol. 96, Jun. 10, 1991, 13 pages.
Goins and Reedy, "Digital Image Analysis in Microscopy for Objects and Architectural Conservation," Objects Specialty Group Postprints, 7, Jun. 12, 2000, 16 pages.
Goldberg, "Genetic Algorithms in Search, Optimization, and Machine Learning," Addison-Wesley Longman Publishing Co., Inc., Boston, MA, published 1989; Chapter 1, pp. 1-25.
Goodchild and Fueten, "Edge Detection in Petrographic Images Using The Rotating Polarizer Stage," Computers and Geosciences, 24:8, Oct. 1998, 7 pages.
Goodchild, "Geological Image Processing of Petrographic Thin Sections using the Rotating Polarizer Stage," A thesis submitted to the Department of Earth Sciences in partial fulfillment of the requirements for the degree of Master of Science, Brock University, St. Catharines, Ontario, Sep. 1998, 166 pages.
Goodfellow et al., "Generative Adversarial Nets," Advances in Neural Information Processing Systems, 2014, 9 pages.
Goovearts, "Chapter 8: Assessment for Spatial Uncertainty," in Geostatistics for natural resources evaluation, Oxford University Press, Jan. 1997, 7 pages.
Gowida et al., "Data-Driven Framework to Predict the Rheological Properties of CaC12 Brine-Based Drill-in Fluid Using Artificial Neural Network," Energies, 2019, 12, 1880, 33 pages.
Graham et al., "Automated Sizing of Coarse-Grained Sediments: Image-Processing Procedures," Mathematical Geology, 37:1, Jan. 2005, 28 pages.
Granjeon and Joseph, "Concepts and applications of a 3D multiple lithology, diffusive model in stratigraphic modeling," Numerical Experiments in Stratigraphy: Recent Advances in Stratigraphic and Sedimentological Computer Simulations, 62, SEPM Special Publication, Jan. 1999, 15 pages.
Granjeon, "Modelisation stratigraphique deterministe: conception et applications d'un modele diffusif 3D multilithologique," Doctoral Thesis, Universit of Rennes 1, 1996, 216 pages.
Graves et al., "Temperatures Induced by High Power Lasers: Effects on Reservoir Rock Strength and Mechanical Properties," Society of Petroleum Engineers (SPE), presented at the SPE/ISRM Rock Mechanics Conference, Irvine, Texas, Oct. 20-23, 2002, 7 pages.
Griffiths et al., "Sedsim in hydrocarbon exploration," Geologic Modeling and Simulation, Kluwer Academic, Jan. 2001, 27 pages.
Grove and Jerram, "jPOR: An ImageJ Macro to Quantify Total Optical Porosity From Blue-Stained Thin Sections," Computers & Geosciences, 37, Nov. 2011, 10 pages.
Guo et al., "Convolutional Neural Networks for Steady Flow Approximation," Association for Computing Machinery (ACM), presented at the 22nd ACM SIGKDD International Conference on Knowledge Discovery and Data Mining—KDD, San Francisco, California, Aug. 13-17, 2016, 10 pages.
Guo et al., "Image Detection Method of Drill Cuttings," Journal of Geophysics and Engineering, 0, 1-9, 2019.
Halliday et al., "Interferometric ground-roll removal: Attenuation of scattered surface waves in single-sensor data," XP001553286, Society of Exploration Geophysicists (SEG), Geophysics, 75:2, Mar. 1, 2010, 11 pages.
Hammerschmidt et al., "Real-time drilling mud gas monitoring for qualitative evaluation of hydrocarbon gas composition during deep sea drilling in the Nankai Trough Kumano Basin", Geochemical Transactions, 2014, 15 pages.
Harbaugh and Carter, "Chapter 1: Introduction, Chapter 2: Models and Simulation" in Computer Simulation in Geology, 99 edition, Wiley, Jan. 15, 1970, 62 pages.
Haworth et al., "Interpretation of Hydrocarbon Shows Using Light (C1-C5) Hydrocarbon Gases from Mud-Log Data", The American Association of Petroleum Geologists Bulletin, Aug. 1985, 69:8 (1305-1310).
Heilbronner, "Automatic Grain Boundary Detection and Grain Size Analysis Using Polarization Micrographs or Orientation Images," Journal of Structural Geology, 2000, 969-981.
Hemink and van der Horst, "On the Use of Distributed Temperature Sensing and Distributed Acoustic Sensing for the Application of Gas Lift Surveillance," SPE Production & Operations., Nov. 2018, 33(04): 896-912, 17 pages.
Hill, "Illuminating Insights Into Well and Reservoir Optimisation using Fiber-Optic Distributed Acoustic Sensing" Society of Petroleum Engineers, Distinguished Lecturer Program, 2018, 35 pages.
Hill, "Permanent real-time full wellbore flow monitoring using distributed fibre-optic sensing," OptaSense, Sep. 2015, 29 pages.
Hoogendoorn et al., "Storms: Process-response modelling of fluvio-deltaic stratigraphy," Computers and Geosciences 34:10, Oct. 2008, 23 pages.
Hoogendoorn, "The impact of changes in sediment supply and sea-level on fluvio-deltaic stratigraphy," PhD., Dissertation, Delft University of Technology, Jan. 31, 2006, 176 pages.
Horst et al., "Latest Developments using Fiber Optic Based Well Surveillance such as Distributed Acoustic Sensing (DAS) for Downhole Production and Injection Profiling," SPE-175211-MS, In SPE Kuwait Oil and Gas Show and Conference, Mishref, Kuwait Society of Petroleum Engineers, Oct. 2015, 10 pages.
Hoshen and Kopelman, "Percolation and cluster distribution, I. cluster multiple labeling technique and critical concentration algorithm," Physical Review Board, vol. 14, No. 8, Oct. 15, 1976, 8 pages.
Hossain, "Relative Permeability Prediction from Image Analysis of Thin Sections," SPE-143606, Society of Petroleum Engineers (SPE), presented at the SPE EUROPEC/EAGE Annual Conference and Exhibition, May 23-26, 2011, 10 pages.
Huang et al., "Numerical forward modelling of 'fluxoturbidite' flume experiments using SEDSIM," Marine and Petroleum Geology vol. 35, Aug. 2012, 11 pages.
Huang et al., "Recent development in stratigraphic forward modelling and its application in petroleum exploration," Australian Journal of Earth Sciences, vol. 62, Issue 8, Jan. 2016, 18 pages.
Huiyun et al., "Review of intelligent well technology," Petroleum, Sep. 2020, 6(3):226-233, 8 pages.
Hurley et al., "Method to Generate Fullbore Images Using Borehole Images and Multi-point Statistics," SPE 120671, SPE Middle East Oil and Gas Show and Conference, Society of Petroleum Engineers, Mar. 15-18, 2009, 18 pages.
Hurst et al., "Predicting Reservoir Characteristics From Drilling and Hydrocarbon-Gas Data Using Advanced Computational Mathematics", 2009 SPE Offshore Europe Oil & Gas Conference & Exhibition, Sep. 2009, 10 pages.
Hussain et al., "Moving Models into Reality: An Automated Workflow to Calibrate Forward Strati graphic Modeling; Application to Hani fa and Arab-D in Central Saudi Arabia", SPE-188920-MS, Society of Petroleum Engineers (SPE), Abu Dhabi International Petroleum Exhibition & Conference, Jan. 1, 2017, 11 pages.
Hutton and Syvitski, "Advances in the numerical modeling of sediment failure during the development of a continental margin," Marine Geology, 203:3-4, Jan. 2004, 14 pages.
Hutton and Syvitski, "Sedflux 2.0: An advanced process-response model that generates three-dimensional stratigraphy," Computer and Geoscience 34:10, Oct. 2008, 19 pages.
Hveding and Porturas , "Integrated Applications of Fiber-Optic Distributed Acoustic and Temperature Sensing," SPE-177222-MS,

(56) References Cited

OTHER PUBLICATIONS

In SPE Latin American and Caribbean Petroleum Engineering Conference, Quito, Ecuador Society of Petroleum Engineers, Nov. 2015, 16 pages.
Igleias et al., "Automatic recognition of hematite grains under polarized reflected light microscopy through image analysis," Minerals Engineering, Pergamon Press: Oxford, GB, 24:12 (1264-1270), Apr. 12, 2011.
In't Panhuis et al., "Flow Monitoring and Production Profiling using DAS", SPE-170917-MS, In SPE Annual Technical Conference and Exhibition, Amsterdam, The Netherlands Society of Petroleum Engineers, 2014, 11 pages.
Izadi et al., "An intelligent system for mineral identification in thin sections based on a cascade approach," Computers and Geoscience, 99, Feb. 2017, 13 pages.
Jayaram et al., "Hydraulic Fracturing Stimulation Monitoring with Distributed Fiber Optic Sensing and Microseismic in the Permian Wolfcamp Shale Play," URTEC-2019-291-MS, In Proceedings of the 7th Unconventional Resources Technology Conference. Denver, Colorado, USA American Association of Petroleum Geologists, Paper presented at the SPE/AAPG/SEG Unconventional Resources Technology Conference, Denver, Colorado, USA, Jul. 2019, 14 pages.
Karssenberg et al., "Conditioning a Process-based Model of Sedimentary Architecture to Well Data," Journal of Sedimentary Research, 71:6, Nov. 2001, 12 pages.
Kendall et al., "The simulation of the sedimentary fill of basins," Journal of Geophysical Research, 96:B4, Apr. 10, 1991, 19 pages.
Kim et al., "Generation of Synthetic Density Log Data Using Deep Learning Algorithm at the Golden Field in Alberta, Canada," Geofluids, 2020, 26 pages.
Krige, "A Statistical Approach to Some Mine Valuation and Allied Problems on the Witwatersrand," thesis submitted for degree of Master of Science in Engineering at the University of Witwatersrand, Mar. 15, 1951, 62 pages.
Kubo et al., "Advance and application of the stratigraphic simulation model 2D-SedFlux: From tank experiment to geological scale simulation," Sedimentary Geology, 178:3-4, Jul. 15, 2005 9 pages.
Kubo et al., "Inverse modeling of post Last Glacial Maximum transgressive sedimentation using 2D-SedFlux: Application to the northern Adriatic Sea," Marine Geology, vol. 234, Issues 1-4, Dec. 18, 2006, 11 pages.
Kursun, "Particle Size and Shape Characteristics of Kemerburgaz Quartz Sands Obtained by Sieving, Laser Diffraction, and Digital Image Processing Methods," Mineral Processing and Extractive Metallurgy Review, 30:4, Oct. 2009, 2 pages, Abstract only.
Laigle et al, "A workflow integrating seismic interpretation and stratigraphic modelling-application to the NPRA Basin," EAGE Research Workshop: From Seismic Interpretation to Stratigraphic and Basin Modelling—Present and Future, Grenoble, Sep. 2006, 6 pages.
Lascelles et al., "Appling Subsurface DNA Sequencing in Wolfcamp Shales, Midland Basin," SPE-184869-MS, Society of Petroleum Engineers (SPE), presented at the SPE Hydraulic Fracturing Technology Conference and Exhibition, the Woodlands, Texas, Jan. 24-26, 2017, 16 pages.
Layman, "Porosity Characterization Utilizing Petrographic Image Analysis: Implications For Identifying and Ranking Reservoir Flow Units, Happy Spraberry Field, Garza County, Texas," Thesis Submitted to the Office of Graduate Studies of Texas A&M University in partial fulfillment of the requirements of the degree of Master Of Science, May 2002, 114 pages.
Leitao et al., "A Multiscale Method for the Reassembly of Two-Dimensional Fragmented Objects," IEEE Transactions on Pattern Analysis and Machine Intelligence, 24:9, Sep. 2002, 13 pages.
Lerat et al., "Construction of a Stochastic Geological Model Constrained by High-Resolution 3D seismic data—Application to the Girassol field, offshore Angola," SPE Annual Technical Conference and Exhibition, vol. 4, No. 110422, Nov. 11, 2007, 16 pages.
Lerche, "An inverse method for determining parameters for folded structures," Quarterly of applied mathematics, 54, Dec. 1996, 11 pages.
Lessenger, "Forward and Inverse Simulation Models of Stratal Architecture and Facies Distributions in Marine Shelf Coastal Plain Environments," PhD Thesis, Colorado School of Mines, 1993, 197 pages.
Li and Nozaki, "Application of Wavelet Cross-Correlation Analysis to a Plane Turbulent Jet," JSME International Journal Series B, 40:1, Feb. 15, 1997, 9 pages.
Li et al., "GIS-based detection of grain boundaries," Journal of Structural Geology, Pergamon Press, 30:4 (431-443), Dec. 27, 2007.
Li et al., "Mixed integer simulation optimization for optimal hydraulic fracturing and production of shale gas fields," Journal of Engineering Optimization, vol. 48, Issue 8, 2016.
Liang et al., "A reduced-complexity model for river delta formation—Part 1: Modeling deltas with channel dynamics," Earth Surface Dynamics 3, Jan. 28, 2015, 20 pages.
Liang et al., "A reduced-complexity model for river delta formation—Part 2: Assessment of the flow routing scheme," Earth Surface Dynamics, vol. 3, Jan. 28, 2015, 18 pages.
Ling et al., "A fast SVD for multilevel block Handkel matrices with minimal memory storage," Numerical Algorithms, Baltzer, Amsterdam, 69:4, Oct. 28, 2014, 17 pages.
Liu and Fomel, "Seismic data analysis using local time-frequency decomposition," Geophysical Prospecting 61:3, May 2013, 21 pages.
Loh et al., "Deep learning and data assimilation for real-time production prediction in natural gas wells," 2018, 7 pages.
Lorenzo-Trueba et al., "A geometric model for the dynamics of a fluvially dominated deltaic system under base-level change," Computers and Geosciences 53, Apr. 2013, 9 pages.
MacQueen, "Some Methods for classification and Analysis of Multivariate Observations," proceedings of 5th Berkeley Symposium on Mathematical Statistics and Probability, 1, Jun. 21-Jul. 18, 1965, published by Berkeley, California, University of California Press, 1967, 17 pages.
Mallat and Zhang, "Matching Pursuits With Time-Frequency Dictionaries," Institute of Electrical and Electronics Engineers (IEEE), IEEE Transactions on Signal Processing 41:12, Dec. 1993, 19 pages.
Marschallinger and Hofmann, "The Application of Object Based Image Analysis to Petrographic Micrographs," Microscopy: Science, Technology, Applications and Education, A. Mendez-Vilas and J. Diaz (Eds.), Formatex, Dec. 2010, 7 pages.
Matthews, "Importance of Sampling Design and Density in Target Recognition," AAPG Memoir 66, pp. 243-253, 1996.
Mehta et al., "Improving the virtual source method by wavefield separation," Geophysics 72:4, Jul.-Aug. 2007, 8 pages.
Mehta et al., "Strengthening the virtual-source method for time-lapse monitoring," Geophysics 73:3, May-Jun. 2008, 8 pages.
Melo, "Formation fluid prediction through gas while drilling analysis relationship between mud gas data and downhole fluid samples," Thesis to obtain Master of Science Degree in Petroleum Engineering, Tecnico Lisboa, Feb. 2016, 89 pages.
Mitchum, "Seismic stratigraphy and global changes of sea level: part 6, Stratigraphic interpretations of seismic reflection patters in depositional sequences, Section 2. Application of seismic reflection configuration of stratigraphic interpretation," American Association of Petroleum Geologists, Jan. 1977, 17 pages.
Molenaar and Cox, "Field Cases of Hydraulic Fracture Stimulation Diagnostics Using Fiber Optic Distributed Acoustic Sensing (DAS) Measurements and Analyses," SPE-164030-MS, In SPE Unconventional Gas Conference and Exhibition. Muscat, Oman Society of Petroleum Engineers, 2013, 10 pages.
Monsen et al., "Quantitative 3D Outcrop Interpretation" SEG Technical Program Expanded Abstracts, 2006, 5 pages.
Monteiro et al., "Uncertainty analysis for production forecast in oil wells," Society of Petroleum Engineers (Spe), SPE Latin America and Caribbean Petroleum Engineering Conference, May 2017, 11 pages.

(56) References Cited

OTHER PUBLICATIONS

Morehead et al, "Modeling the temporal variability in the flux of sediment from ungauged river basins," Global and Planetary Change, 39:1-2, Oct. 2003, 16 pages.
Mutyala et al., "Microwave applications to oil sands and petroleum: A review," Fuel Process Technol, 2010, 91:127-135.
Naldrett et al., "Production Monitoring Using Next-Generation Distributed Sensing Systems," Petrophysics—The SPWLA Journal of Formation Evaluation and Reservoir Description, Aug. 2018, 59(4): 496-510, 15 pages.
Nicolas et al., "Forward Stratigraphic Modelling, Deterministic Approach to Improve Carbonate Heterogeneity Prediction; Lower Cretaceous, Abu Dhabi," International Petroleum Exhibition and Conference, Nov. 9-12, 2015, 16 pages.
Nordlund, "Formalizing geological knowledge with an example of modeling stratigraphy using fuzzy logic," Journal of Sedimentary Research 66:4, Jul. 1, 1996, 10 pages.
Nordlund, "FUZZIM: forward stratigraphic modeling made simple," Computers and Geosciences, 25:4, May 1999, 8 pages.
Nourbakhsh et al., "Embedded sensors and feedback loops for iterative improvement in design synthesis for additive manufacturing," American Society of Mechanical Engineers (ASME), presented at the ASME 2016 International Design Engineering Technical Conference and Information in Engineering Conference, Charlotte, NC, 9 pages.
Obamawhitehouse.archives.gov (online), "Fact Sheet: Announcing the National Microbiome Initiative," released on May 13, 2016, retrieved from URL <https://obamawhitehouse.archives.gov/the-press-office/2016/05/12/fact-sheet-announcing-national-microbiome-initiative>, retrieved on Feb. 8, 2021, 4 pages.
Obara et al., "Utilisation of the Image Analysis Method for the Detection of the Morphological Anisotropy of Calcite Grains in Marble," Computer Geoscience, 2007, 7 pages.
Obara, "An Image Processing Algorithm for the Reversed Transformation of Rotated Microscope Images," Computers & Geosciences, 853-859, 2007.
O'brien et al., "StarWars Laser Technology for Gas Drilling and Completions in the 21st Century," Society of Petroleum Engineers (SPE), presented at the SPE Annual Technical Conference and Exhibition, Houston, Texas, Oct. 3-6, 1999, 10 pages.
Ono et al., "Measurement of a Doubly Substituted Methane Isotopologue, 13CH3D, by Tubable Infrared Laser Direct Absorption Spectroscopy," Analytical Chemistry, 86, Jun. 2014, 8 pages.
opendtect.org' [online], "Open Seismic Repository," available on or before Dec. 7, 2017, [retrieved on Jun. 11, 2018], retrieved from URL: <http://opendtect.org/osr/>, 2 pages.
Overeem et al., "Three-dimensional numerical modeling of deltas," SEPM Special Issue, 83, River Deltas: concepts, models and examples, Jan. 2005, 19 pages.
Paleja et al., "Velocity Tracking for Flow Monitoring and Production Profiling Using Distributed Acoustic Sensing," SPE-174823-MS, In SPE Annual Technical Conference and Exhibition. Houston, Texas, USA Society of Petroleum Engineers, Sep. 28, 2015, 16 pages.
Paulsen et al.; "A Simple Method for Orienting Drill Core by Correlating Features in Whole-Core Scans and Oriented Borehole-Wall Imagery"; Journal of Structural Geology; Published in 2002; pp. 1233-1238.
Percak-Dennett et al., "High Resolution Dynamic Drainage Height Estimations using Subsurface DNA Diagnostics," SPE-195266-MS, Society of Petroleum Engineers (SPE), presented at the SPE Western Regional Meeting, San Jose, California, Apr. 23-26, 2019, 7 pages.
Perring et al., "Using Automated Digital Image Analysis to Provide Quantitative Petrographic Data on Olivine-Phyric Basalts," Computers & Geosciences, 30, Mar. 2004, 13 pages.
Pevzner et al., "Repeatability analysis of land time-lapse seismic data: CO2CRC Otway pilot project case study," Geophysical Prospecting 59, Jan. 2011, 12 pages.
Pirmez et al., "Clinoform development by advection-diffusion of suspended sediment: Modeling and comparison to natural systems," Journal of Geophysical Research, 103:24, Oct. 10, 1998, 18 pages.
Poplavskii et al., "Two-dimensional inverse modeling of sedimentary basin subsidence," Journal of Geophysical Research, 106:B4, Apr. 10, 2001, 15 pages.
PTTC Technology Connections, "Surface Hydrocarbon Detection Shows Promise," Published on or before Feb. 1999, 2 pages.
Qayyum et al., "A modern approach to build 3D sequence stratigraphic framework," Oil and Gas Journal 111, Oct. 2013, 16 pages.
Rafidah et al., "A review of stratigraphic simulation techniques and their applications in sequence stratigraphy and basin analysis," Bulletin of the Geological Society of Malaysia, 54, Nov. 2008, 11 pages.
Rasheed et al., "Application of geo-microbial prospecting method for finding oil and gas reservoirs," Frontier Earth Science, 2014, 11 pages.
Rasheed et al., "Bacteria as indicators for finding oil and gas reservoirs: A case study of the Bikaner-Nagaur Basin, Rajasthan, India," Pet. Sci., 2011, 8:264-268, 5 pages.
Reedy and Kamboj, "Image Analysis Protocol Instructions #1: Spatial Calibration of Images, Project Report," University of Delaware, Laboratory of Analysis of Cultural Materials, 2004, 9 pages.
Reedy et al., "Image Analysis in Quantitative Particle Studies of Archaeological Ceramic Thin Sections," Advances in Archaeological Practice, 2:4, Nov. 2014, 17 pages.
Reedy, "Review of Digital Image Analysis of Petrographic Thin Sections in Conservation Research," Journal of the American institute for Conservation, 45:2, Jun. 2006, 8 pages.
Remy et al., "Geostatistics: a recall of concepts," in Applied geostatistics with SGeMS: A user's guide, Cambridge University Press, Jul. 2009, 5 pages.
Richa et al., "Image Analysis and Pattern Recognition for Porosity Estimation from Thin Sections," SEG Technical Program Expanded Abstracts, Jan. 2006, 5 pages.
Richter et al., "Hydraulic fracture monitoring and optimization in unconventional completions using a high-resolution engineered fibre-optic Distributed Acoustic Sensor," First Break., Apr. 2019, 37(4): 63-68, 6 pages.
Rijks et al. "Attribute extraction: an important application in any detailed 3-D interpretation study," Geophysics: The Leading Edge of Exploration, Sep. 1991, 9 pages.
Ritchie et al., "Three-dimensional numerical modeling of deltaic depositional sequences 1: Influence of the rate and magnitude of sea-level change," Journal of Sedimentary Research, vol. 74, Issue 2, Mar. 1, 2004, 18 pages.
Ritchie et al., "Three-dimensional numerical modeling of deltaic depositional sequences 2: Influence of the rate and magnitude of sea-level change," Journal of Sedimentary Research, 74:2, Mar. 1, 2004, 18 pages.
Roksandic et al., "Seismic Facies Analysis Concepts," Geophysical Prospecting, vol. 26, No. 2, Jun. 1, 1978, 16 pages.
Rostami et al., "Developing a Committee Machine Model for Predicting Reservoir Porosity from Image Analysis of Thin Sections," proceedings of the 20th Formation Evaluation Symposium of Japan, Oct. 1-2, 2014, 11 pages.
Ruzyla, "Characterization of Pore Space by Quantitative Image Analysis," SPE Formation Evaluation, Aug. 1986, 10 pages.
Sacchi et al., "Towards process-based geological reservoir modelling: Obtaining basin-scale constraints from seismic and well data," Marine and Petroleum Geology 61, Mar. 2015, 13 pages.
Saharan et al., "Reassembly of 2D Fragments in Image Reconstruction," International Journal of Computer Applications, 0975-8887, 19-5, Apr. 2011, 5 pages.
Saidian et al., "Qualitative and Quantitative Reservoir Bitumen Characterization: A Core to Log Correlation Methodology", 2014-SSSS SPWLA Conference Paper, 16 pages.
Salehi et al., "Laser drilling—drilling with the power of light," Gas Technology Institute Report, 2000-2007 period report, Chicago, IL, 318 pages.

(56) References Cited

OTHER PUBLICATIONS

Sanni et al., "Lessons Learned from In-well Fiber-optic DAS/DTS Deployment," SPE-191470-MS, In SPE Annual Technical Conference and Exhibition. Dallas, Texas, USA Society of Petroleum Engineers, Sep. 2018, 12 pages.
San-Roman-Alergi et al., "Machine learning and the analysis of high-power electromagnetic interaction with subsurface matter," Society of Petroleum Engineers (SPE), presented at the SPE Middle East Oil and Gas Show and Conference, Manama, Bahrain, Mar. 18-21, 2019, 11 pages.
San-Roman-Alerigi et al., "Geomechanical and thermal dynamics of distributed and far-field dielectric heating of rocks assisted by nano-enablers—A numerical exploration," Society of Petroleum Engineers (SPE), presented at the SPE Abu Dhabi International Petroleum Exhibition and Conference, Abu Dhabi, UAE, Nov. 13-16, 2017, 21 pages.
San-Roman-Alerigi et al., "Numerical Modeling of Thermal and Mechanical Effects in Laser-Rock Interaction—An Overview," presented at the 50th U.S. Rock Mechanics/Geomechanics Symposium, Houston, TX, Jun. 26-29, 2016; American Rock Mechanics Association, 2016, 11 pages.
Sawaryn et al., "A Compendium of Directional Calculations Based on the Minimum Curvature Method," SPE-84246-PA, Society of Petroleum Engineers (SPE), SPE Drilling & Completions 20:1, Jan. 2005, 24-36, 13 pages.
Schepers et al., "Optimized Reservoir History Matching Simulation of Canyon Formation, SACROC Unit, Permian Basin," Topical Report, Department of Energy, Nov. 9, 2007; 79 pages.
Schumacher, D. and M.A. Abrams, eds., 1996, "Hydrocarbon Migration and Its Near-Surface Expression," AAPG Memoir, 66, pp. 445.
Seleznev et al., "Formation properties derived from a multi-frequency dielectric measurement," SPWLA 47th Annual Logging Symposium, Jun. 4-7, 2006, 12 pages.
Seybold et al., "Modeling river delta formation," proceeding of the National Academy of the United States of America, vol. 104, Issue 43, Oct. 23, 2007, 6 pages.
Sharma and Sharma, "Image Segmentation Using Morphological Operation for Automatic Region Growing," International Journal of Innovative Research in Computer and Communication Engineering, 2:9, Sep. 2014, 7 pages.
Sharma et al., "Well-scale multiphase flow characterization and validation using distributed fiber-optic sensors for gas kick monitoring," Optics Express., Dec. 2020, 28(26): 38773, 15 pages.
Sharma, "Quantitative stratigraphic inversion," Dissertation for degree of Doctor of Philosophy in Geosciences, Virginia Polytechnic Institute and State University, Dec. 6, 2006, 105 pages.
Sheppard et al., "Techniques for image enhancement and segmentation of tomographic images of porous materials," Physica A: Statistical Mechanics and its Applications, vol. 339, No. 1-2, Aug. 1, 2004, 7 pages.
Silkina, "Application of Distributed Acoustic Sensing to Flow Regime Classification," Thesis at: Norwegian University of Science and Technology, Jun. 2014, 51 pages.
Singh et al., "Facies Classification Based on Seismic Waveform—A Case Study from Mumbai High North," 2004, 5th Conference & Exposition on Petroleum Geophysics, Hyderabad—2004, India, pp. 456-462.
Sivanandam et al., "Introduction to Genetic Algorithms," Springer-Verlag Berlin Heidelberg, published 2008; Chapter 2, pp. 15-36.
Slupik, et al., "The stratigraphy of the Neogene-Quaternary succession in the southwest Netherlands from the Schelphoek borehole (42G4-11/42G0022)—a sequence-stratigraphic approach. Netherlands," Journal of Geosciences 86:4, Dec. 2007, 16 pages.
Smith and Beermann, "Image Analysis of Plagioclase Crystals in Rock Thin Sections using Grey Level Homogeneity Recognition of Discrete Areas," Computers & Geosciences 33, Mar. 2007, 22 pages.
Stagars et al., "Microbial Community Response to Simulated Petroleum Seepage in Caspian Sea Sediments," Frontiers in Microbiology, Apr. 2017, 8:764, 16 pages.
Starkey et al., "A Microcomputer-Based System for Quantitative Petrographic Analysis," Computers & Geosciences, 20:9 (1285-1296), 1994.
Ŝt'astná et al., "Cathodoluminescence Microscopy and Petrographic Image Analysis of Aggregates in Concrete Pavements Affected by Alkali-Silica Reaction," Materials Characterization, 65, Mar. 2012, 11 pages.
Sun et al., "Comparison of declin curve analysis DCA with recursive neural networks RNN for production forecast of multiple wells," Society of Petroleum Engineers (SPE), SPE Western Regional Meeting, Apr. 2018, 11 pages.
Syvitski and Hutton, "2D Sedflux 1.0C: an advanced process-response numerical model for the fill of marine sedimentary basins," Computer and Geosciences 27:6, Jul. 2001, 23 pages.
Syvitski and Hutton, "Failure of Marine Deposits and their Redistribution by Sediment Gravity Flows," Pure and Applied Geophysics, 160:10-11, Oct. 2003, 17 pages.
Syvitski et al., "HydroTrend: a climate-driven hydrological transport model for predicting discharge and sediment to lakes or oceans," Computer Geoscience, vol. 24, Issue 1, Jan. 29, 1998, 18 pages.
Tarantola et al., "Inverse Problem Theory and Methods for Model Parameter Estimation," Society for the Industrial and Applied Mathematics (SIAM), published 2005; Chapter 3, pp. 57-80.
Tarquini et al., "A Microscopic Information System (MIS) for Petrographic Analysis," Computers and Geosciences, 36:5 (665-674), May 1, 2010.
Teagle et al.; "Methods" Proceedings of the Integrated Ocean Drilling Program, vol. 309/312; Published in 2006, 1-70.
Tetzlaff, "Input uncertainty and conditioning in siliciclastic process modelling, Geological Prior Information: Informing Science and Engineering," Geological Society, London, Special Publications, vol. 239, Jan. 2004, 15 pages.
Thomas et al.; "Rock Physics and Formation Evaluation: Automated Lithology Extraction from Core Photographs" First Break, vol. 29; Jun. 1, 2011, 103-109.
Thompson et al., "Designing and Validating 2D Reservoir Models," SPE-188066-MS, Society of Petroleum Engineers (SPE), SPE Kingdom of Saudi Arabia ATSE, Apr. 2017, 13 pages.
Tissot et al., "Petroleum Formation and Occurrence," Springer-Verlag Berlin Heidelberg, published 1984, 2nd edition; Chapter 26, pp. 1-33.
towardsdatascience.com [online], "K-Means Clustering—Explained," Yildrim, Mar. 2020, retrieved on May 19, 2021, retrieved from URL <https://towardsdatascience.com/k-means-clustering-explained- 4528df86a120#:~:text=K%2Dmeans%20clustering%20aims%20to,methods%20to%20measure%20the%20distance>, 12 pages.
towardsdatascience.com [online], "Support vector machine—introduction to machine learning algorithms," Ghandi, Jul. 7, 2018, retrieved May 19, 2021, retrieved from URL <https://towardsdatascience.com/support-vector-machine-introduction-to-machine-learning-algorithms-934a444fca47>, 12 pages.
Trickett et al., "Robust rank-reduction filtering for erratic noise," Society of Exploration Geophysicists (SEG), presented at the SEG Las Vergas 2012 Annual Meeting, Nov. 4-9, 2012, 5 pages.
Ulrych et al., "Tutorial: Signal and noise separation: Art and science," Geophysics 64:5, Sep.-Oct. 1999, 9 pages.
Vaferi et al., "Modeling and analysis of effective thermal conductivity of sandstone at high pressure and temperature using optimal artificial neural networks," Journal of Petroleum Science and Engineering, 2014, 119, 10 pages.
Van Der Horst et al., "In-Well Distributed Fiber Optic Solutions for Reservoir Surveillance," OTC 23949, In Offshore Technology Conference, Houston, Texas, USA Offshore Technology Conference, 2013, 6 pages.
Van der Horst, "Recent Advances in Fiber Optic Technology for In-Well Production and Injection Profiling," IPTC-18563-MS, In International Petroleum Technology Conference, Doha, Qatar International Petroleum Technology Conference, Dec. 2015, 14 pages.

(56) References Cited

OTHER PUBLICATIONS

Van Der Meer et al., "Hyperspectral Hydrocarbon Microseepage Detection and Monitoring: Potentials and Limitations," published in 2000, 9 pages.
Van der Neut and Bakulin, "Estimating and correcting the amplitude radiation pattern of a virtual source," Geophysics 74:2, Mar.-Apr. 2009, 10 pages.
Van der Neut et al., "Controlled-source interferometric redatuming by crosscorrelation and multidimensional deconvolution in elastic media," Geophysics 76:4, Jul.-Aug. 2011, 14 pages.
Van der Neut, "Interferometric redatuming by multidimensional deconvulution," Thesis for the degree of Master of Applied Geophysics, Technische Universiteit Delft, Dec. 17, 2012, 295 pages.
Van Laarhoven et al., "Simulated Annealing: Theory and Applications," Mathematics and Its Applications (Book 37), Springer Netherlands, 1987 edition; Chapters 1-2, pp. 1-15.
Vanorio et al., "How mecrite content affects and the transport, seismic and reactive properties of carbonate rocks: Implications for 4D seismic," SEG International Exposition and Annual Meeting, Houston, Oct. 25-30, 2009, 5 pages.
Vesnaver et al., "Geostatistical integration of near-surface geophysical data," Geophysical Prospecting, 2006, 54:6 (763-777), 15 pages.
Vinther et al., "3-D seismic texture classification," Presented at the European 3-D Reservoir Modelling Conference, Society of Petroleum Engineers, Apr. 16-17, 1996, 7 pages.
Vossler, "Automatic delineation of lateral facies changes in clastic environments," presented at the 59th Annual International meeting, Society of Exploration Geophysicists, paper SI 5.4, Oct. 29-Nov. 2, 1989, 2 pages.
Wang et al., "Design and Calculation of Complex Directional-Well Trajectories on the Basis of the Minimum-Curvature Method," Society of Petroleum Engineers (SPE), SPE Drilling and Completion 34:2 (173-188), Jun. 2019, 16 pages.
Wapenaar and Fokkema, "Green's function representations for seismic interferometry," Geophysics 71:4, Jul.-Aug. 2006, 14 pages.
Wardaya et al., "Integrating Digital Image Processing and Artificial Neural Network for Estimating Porosity from Thin Section," Paper IPTC-16959, presented at the International Petroleum Technology Conference, Mar. 26-28, 2013, 10 pages.
Weger et al., "Quantification of pore structure and its effect on sonic velocity and permeability in carbonates," AAPG Bulletin, vol. 93, No. 10, Oct. 2009, 21 pages.
Weichang et al., "Deep Learning for Quantitative Hydraulic Fracture Profiling from Fiber Optic Measurements," paper prepared for presentation at the Unconventional Resources Technology Conference held in Houston, Texas, USA, Jul. 26-28, 2021, 8 pages.
WellCAD Software, "4.4 Book 1—Basics," V2011.10.17, ALT, Oct. 17, 2011, 11 pages.
Weltje et al., "Stratigraphic inversion of siliciclastic basin fills: a note on the distinction between supply signals resulting from tectonic and climatic forcing," Basin Research, vol. 10, Jun. 28, 1998, 25 pages.
Wheaton et al., "A Case Study of Completion Effectiveness in the Eagle Ford Shale Using DAS/DTS Observations and Hydraulic Fracture Modeling," SPE-179149-MS, In SPE Hydraulic Fracturing Technology Conference, The Woodlands, Texas, USA Society of Petroleum Engineers, 2016, 11 pages.
Wijns et al., "Interactive inverse methodology applied to stratigraphic forward modelling," Geological Prior Information: Informing Science and Engineering, Geological Society, London, Special Publications 239, 2004, 9 pages.
Wijns et al., "Inverse modelling in geology by interactive evolutionary computation," Journal of Structural Geology, 25, Jan. 9, 2003, 11 pages.
Wikipedia.com [online], "Artificial neural network," available on or before May 2020, retrieved on May 10, 2020, retrieved from URL: <https://en.wikipedia.org/w/index.php?title=Artificial neural network &oldid-955889246>, 27 pages.
wikipedia.org [online], "Hankel matrix," retrieved on Oct. 4, 2020, retrieved from URL <https://eri.wikipedia.org/wiki/Harikelmatrix>, Aug. 7, 2020, 5 pages.
Wilkens et al.; "Data Report: Digital Core Images as Data: An Example from IODP Expedition 303"; Proceedings of the Integrated Ocean Drilling Program, vol. 303/306; Published in 2009; pp. 1-16.
Wood, "Predicting porosity, permeability and water saturation applying an optimized nearest-neighbour, machine-learning and data-mining network of well-log data," Journal of Petroleum Science and Engineering, 2019, 54 pages.
Xiao et al., "Intelligent Distributed Acoustic Sensing for In-well Monitoring," SPE-172197-MS, In SPE Saudi Arabia Section Technical Symposium and Exhibition, Al-Khobar, Saudi Arabia Society of Petroleum Engineers, Apr. 2014, 12 pages.
Yang et al., "A machine learning approach to predict gas oil ratio based on advanced mud gas data," SPE 195459, Society of Petroleum Engineers, Jan. 2019, 17 pages.
Yin et al., "A hierarchical streamline-assisted history matching approach with global and local parameter updates," Journal of Petroleum Science and Engineering, vol. 80, No. 1, Dec. 2011; pp. 116-130.
Yin et al., "FMI image based rock structure classification using classifier combination," Neural Computing and Applications, 2011, vol. 20, No. 7; pp. 955-963.
Yu et al., "Wavelet-Radon domain dealiasing and interpolation of seismic data," Geophysics 72:2, Mar.-Apr. 2007, 9 pages.
Zehui et al., "Permeability prediction with artificial neural network modeling in the venture gas field, offshore eastern Canada," Geophysics, Mar. 1996, 61(2):422-436, 16 pages.
Zeljkovic et al., "An algorithm for petro-graphic colour image segmentation used for oil exploration," High Performance Computing and Simulation (HPCS), 2011 International Conference on IEEE, Jul. 4, 2011, 6 pages.
Zeng et al., "Optimal Selection of Stimulation Wells Using a Fuzzy Multicriteria Methodology," Mathematical Problems in Engineering, 2019, 13 pages.
Zhang et al., "A statistical information reconstruction method of images based on multiple-point geostatistics integrating soft data with hard data," presented in the ISCSCT'08 International Symposium, Computer Science and Technology vol. 1, Dec. 2008, 6 pages.
Zhang et al., "Characterizing Stratigraphic Traps Using Improved Waveform Classification Seismic Facies Analysis: An Example from Central Saudi Arabia," Dec. 2016, First Break vol. 34, pp. 77-84.
Zhang et al., "Evolutionary Computation and Its Applications in Neural and Fuzzy Systems," Applied Computational Intelligence and Soft Computing, vol. 2011, No. 7, Jan. 2011; 20 pages.
Zhang et al., "Porous media reconstruction using a cross-section image and multiple-point geostatistics," presented at the ICACC'09 International Conference, Advanced Computer Control, Feb. 2009, 6 pages.
Zhao and Burnstad, "A new virtual source redatuming procedure to improve land 4D repeatability," Society of Exploration Geophysicists (SEG), presented at the 2015 SEG Annual Meeting, Oct. 18-23, 2015, 4 pages.
Zhao et al., "Estimating permeability of shale-gas reservoirs from porosity and rock compositions", Geophysics, 83:5, 2018, 12 pages.
Zhao et al., "Virtual-source imaging and repeatability for complex near surface," Scientific Reports: Nature Search, 9:16656, 2019, 18 pages.
Zhou et al., "Segmentation of petrographic images by integrating edge detection and region growing," Computers and Geosciences, Pergamon Press, vol. 30, No. 8, Oct. 1, 2004, 15 pages.
Zinati, "Using Distributed Fiber-Optic Sensing Systems to Estimate Inflow and Reservoir Properties," Technische Universiteit Delft, 2014, 135 pages.

* cited by examiner

QUANTITATIVE HYDRAULIC FRACTURING SURVEILLANCE FROM FIBER OPTIC SENSING USING MACHINE LEARNING

CROSS REFERENCE TO RELATED APPLICATIONS

This application claims priority to U.S. Provisional Patent Application No. 63/239,014, filed Aug. 31, 2021, the entire contents of which are incorporated herein by reference.

TECHNICAL FIELD

The present disclosure describes quantitative hydraulic fracturing surveillance from fiber optic sensing using machine learning.

BACKGROUND

Generally, fiber optic sensing is implemented in a wellbore environment via a logging tool that includes at least one fiber optic sensor for capturing a measurement in the wellbore environment. A fiber optic line is in optical communication with the fiber optic sensor. The data captured by the fiber optic sensor is transmitted through the fiber optic line in real time, and the fiber optic sensor can be a passive sensor not requiring electrical or battery power.

DETAILED DESCRIPTION

Embodiments described herein enable quantitative hydraulic fracturing surveillance from fiber optic sensing using machine learning. The present techniques include fiber-optic distributed sensing. Fiber optic distributed sensing, such as distributed acoustic sensing (DAS), distributed temperature sensing (DTS) and microseismic, has been increasingly used in unconventional fields for intelligent completions, production monitoring, and optimization. Advancement in fiber-optic distributed sensing technology in the past decades has made it possible to reveal critical operational information in situ and in real time. The analysis of a large volume of fiber-optic sensing data and their association with operation states remains mostly qualitative, correlative and after-fact descriptive. The present techniques include deep learning based methods that directly predict operation states and variables, including the pumping variables, the production flow pressure and rates, and the fracking cluster locations, from all the available fiber-optic measurements. Additionally, the present techniques establish an automated quantitative framework for intelligent completion and production monitoring, with minimal manual interpretation or intervention. When combined with efficient pre-processing of the raw measurement data, this will enable DAS/DTS based field monitoring to improve real-time operation decision making. For example, real time decisions can be made to correct issues discovered based on the predicted data.

DAS measurements tend to accumulate significant amount raw data and even simple spectral analysis can be computationally costly and complex, due to the large channel numbers, high sampling frequency, and long time duration over which the measurements are taken. Traditionally, associating the processed DAS information with operation variables and states of interest are generally qualitative, correlative and after-fact descriptive, requiring significant amount of human intervention and interpretation. This can be cumbersome and even infeasible for applications involving long duration monitoring. Accordingly, the present techniques enable automated and quantitative processing frameworks capable of predicting operation states or variable values directly from fiber optic DAS and/or DTS data, with minimal manual intervention. When combined with efficient pre-processing of the raw measurement data, this DAS/DTS based field monitoring to improve real-time operation decision making in enabled. In some embodiments, time traces of DAS at each depth location are transformed into the time-spectral domain. The magnitude of the transformed data in certain frequency bands most correlated with operation variables of interest are identified and collated with operation states as the so-called frequency band extracted (FBE) signals. The present techniques enable direct modeling from DAS and/or DTS data to hydraulic fracturing characteristics or production variables.

Figure 1:
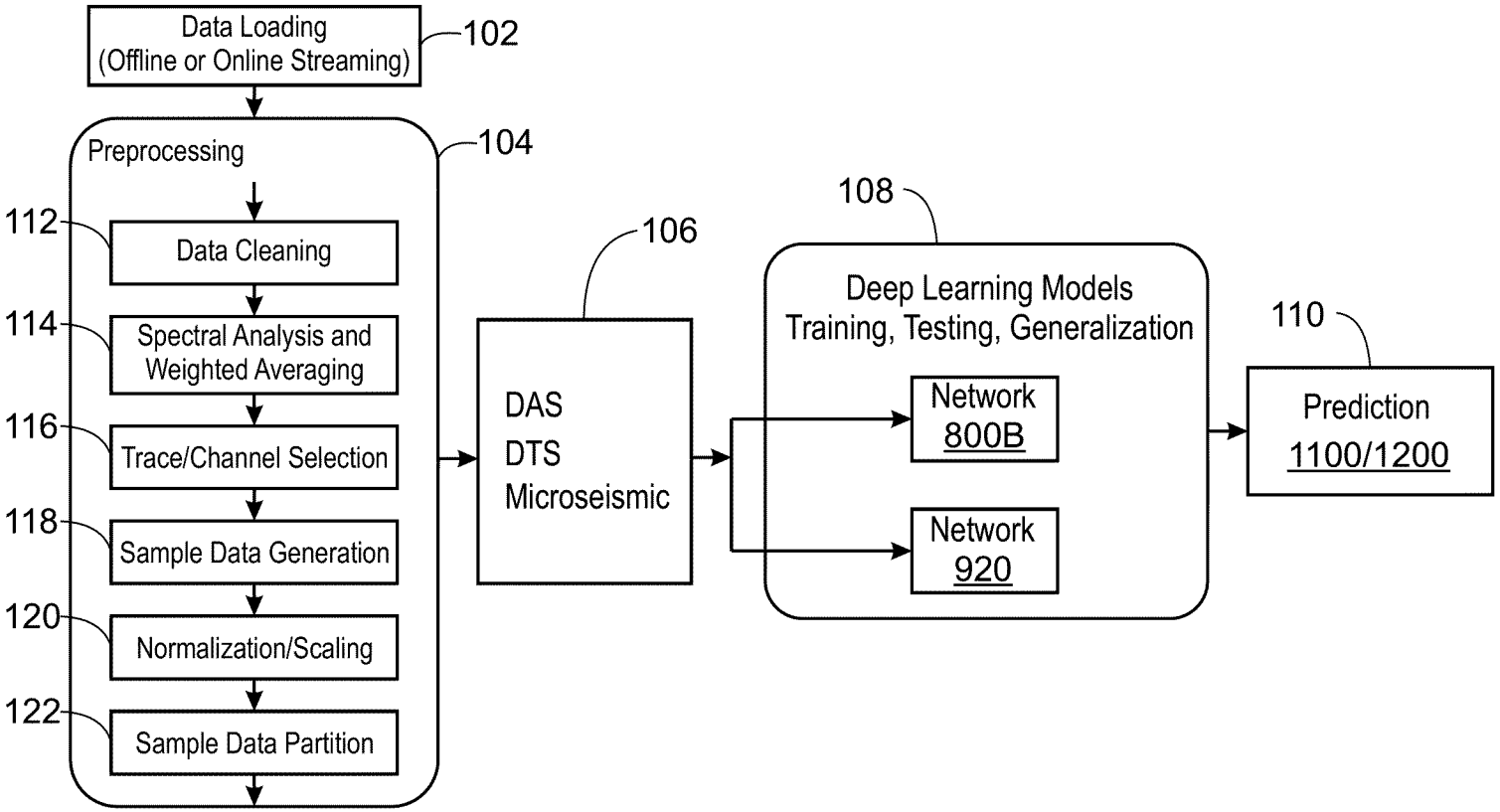
FIG. 1 is a block diagram of a system that enables quantitative hydraulic fracturing surveillance from fiber optic sensing using machine learning.

FIG. 1 is a block diagram of a system that enables quantitative hydraulic fracturing surveillance from fiber optic sensing using machine learning. In the example of FIG. 1, the system 100 obtains as input DAS, DTS, and microseismic data. Accordingly, the data is loaded (102), and the data is preprocessed (104) to obtain a set of sample data 106. The sample data includes, for example, DAS, DTS, and microseismic snapshot images. Deep learning models 108 are trained, tested, and validated. Once trained, the deep learning models 108 execute on unseen DAS, DTS, and microseismic snapshot images to predict operation states and variables. In some embodiments, the events are localized. Accordingly, in some embodiments, machine learning based methods are developed for quantitatively predicting (110) hydraulic fracturing profiling from fiber optic distributed acoustic sensing (DAS), distributed temperature sensing (DTS) and/or microseismic data, or any combination of these data, and identify and localize the events. FIG. 1 shows direct prediction 110 of pressure and slurry rate from DAS/DTS/microseismic data using deep neural networks.

DAS and DTS is used to record vibration and temperature around a fiber, respectively. To determine operational and completion design efficiency, DAS/DTS and microseismic data are monitored during the perforation and the actual hydraulic fracturing pump phases. In some embodiments, the pump data (e.g., slurry rates, pressures) is predicted using the DAS/DTS and microseismic measurement over the monitored stages. The inputs to the deep learning models 108 are the preprocessed data samples 106 partitioned from these measurements and their transformed results. In examples, the DAS and microseismic data are converted into spectrogram and then time segmented during preprocessing 104. The present techniques include, at least in part, three types of deep learning models 108: I) A multimodal ResNet network, which maps time snapshots of these measurement samples to the synced pump data independently; II) a multimodal ResNet followed by convolutional LSTM sequence learning model maps time segments of these measurement samples into the synced hydraulic fracturing flow data; and III) constrained version of I and II by enforcing the prediction to be consistent with the learned relationship between the flow pressure and rates. In examples, the models and their constrained versions are trained over a randomly partitioned subset of samples before applied to the remaining testing samples.

In examples, the models and their constrained versions are trained and tested over a DAS/DTS and microseismic dataset acquired over one hour duration with known flow data during hydraulic fracturing process and production phase. The trained models perform robustly over the testing samples and produce accurate prediction. The LSTM sequence-learning model as described herein produces a smoother and more consistent pressure and slurry rate prediction. The trained deep learning models enable an accurate prediction of the pump data from the fiber optic measurements, and also enable an automated and quantitative way to analyze and predict stage isolation state, cluster locations, and determine the fluid profile. In examples, stages here refer to a specific hydraulic fracking process which starting from bottom of the well, perforates and fracks over a certain well depth range (along the well, not necessarily vertical) before sealing it and moving up to perforate and frack the next depth range above; each one of these depth range is called stage. Stages are different well depth ranges and their operations are also separated over time.

In examples, the input data includes DAS input, DTS input, and microseismic input. In examples, the DAS data is sampled at a sample rate fs, das (e.g. 2 kHz), from a total of $N_{das}$ (e.g. 493) DAS channels recorded vibrations along the lateral with a spacing $d_{das}$ (e.g. of approximately 16.74 ft (5.1 m)). The DAS data can be in sgy files, HDF5, or other data file format. Each of the files store a certain time duration $T_{das}$ (e.g. 3000 second long) signal of $N_{das}$ (e.g. 493) traces. In examples, the DTS data is recorded at a sample rate of $f_{s,dts}$ (e.g. 30 Hz). The space resolution $d_{dts}$ (e.g. approximately 1 ft or 30.48 cm) during hydraulic fracture stimulation. The DTS data can be from a csv file, an HDF5 file or some other format, where each row represents one depth value with total number of channels N, and each column represent one time point, with the total number of columns $T_{dts}$. In examples, the micro-seismic data is sampled at a sample rate of $f_{s,ms}$ (e.g. 2 kHz). A total of $N_{ms}$ (e.g. 36) channels are recorded in the monitoring well. The microseismic data can be from sgy files, HDF5, or other data file format, where each file stores a certain time duration $T_{ms}$ (e.g. 3-second) long signal of $N_{ms}$ (e.g. 36) traces.

Figure 7:
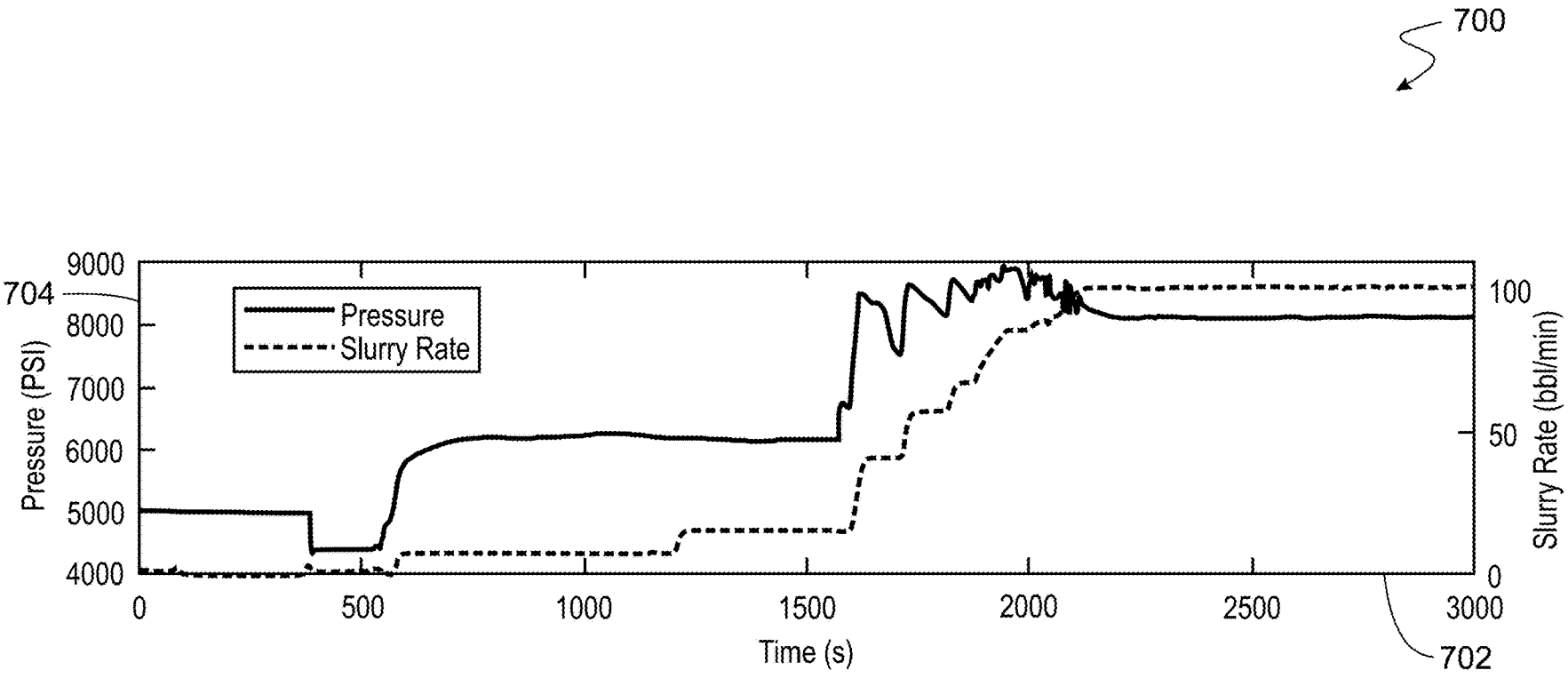
FIG. 7 is an illustration of an example hydrofracturing pumping data (pressure and slurry rate).

In examples, the output data includes injection or pumping data output. FIG. 7 is an illustration of an example hydrofracturing pumping data (pressure and slurry rate). The plot 700 shows time along the x-axis 702 and pressure along the y-axis 704. In examples, injection or pumping data consists of the pressure and the flow/slurry rate, typically measured at the surface. Injection data flow rates are generally provided in terms of different phases such as $CO_2$ or water, as applicable. The injection/pumping data is recorded as a sample rate of $f_{s,pmp}$ (e.g. 1 Hz). The injection/pumping data is saved in a csv file or other data format. In examples, the output data includes production data output: production data consists of pressure and multiphase production flow rates, sampled at sample rates of $f_{s,prod,p}$ and $f_{s,prod,r}$, respectively. The rates are provided in terms of oil, gas and water. The production data may be measured from the surface or downhole.

Referring again to FIG. 1, data loading 102 is shown and preprocessing 104. In data loading 102, data can be loaded from data files in offline mode or online streaming mode from data acquisition database. Since the inputs and outputs consist of multiple measurements and variables, the availability of various data over the time axis is determined. The time windows over which measurements are available or of acceptable quality can vary. In examples, a common time window or durations where all measurements are available is determined.

For the DAS and micro-seismic data in the offline mode, each file only contains a small segment of data. Data is iteratively read from the files within the determined time window, the data segments are concatenated. DTS, injection, pumping, and production data are also read from files within a determined time window. However, for the DTS injection/pumping or production data, due their significantly smaller data size compared to DAS or microseismic, the entire data set can be directly loaded if each is provided in a single file for the entire duration.

Figure 3:
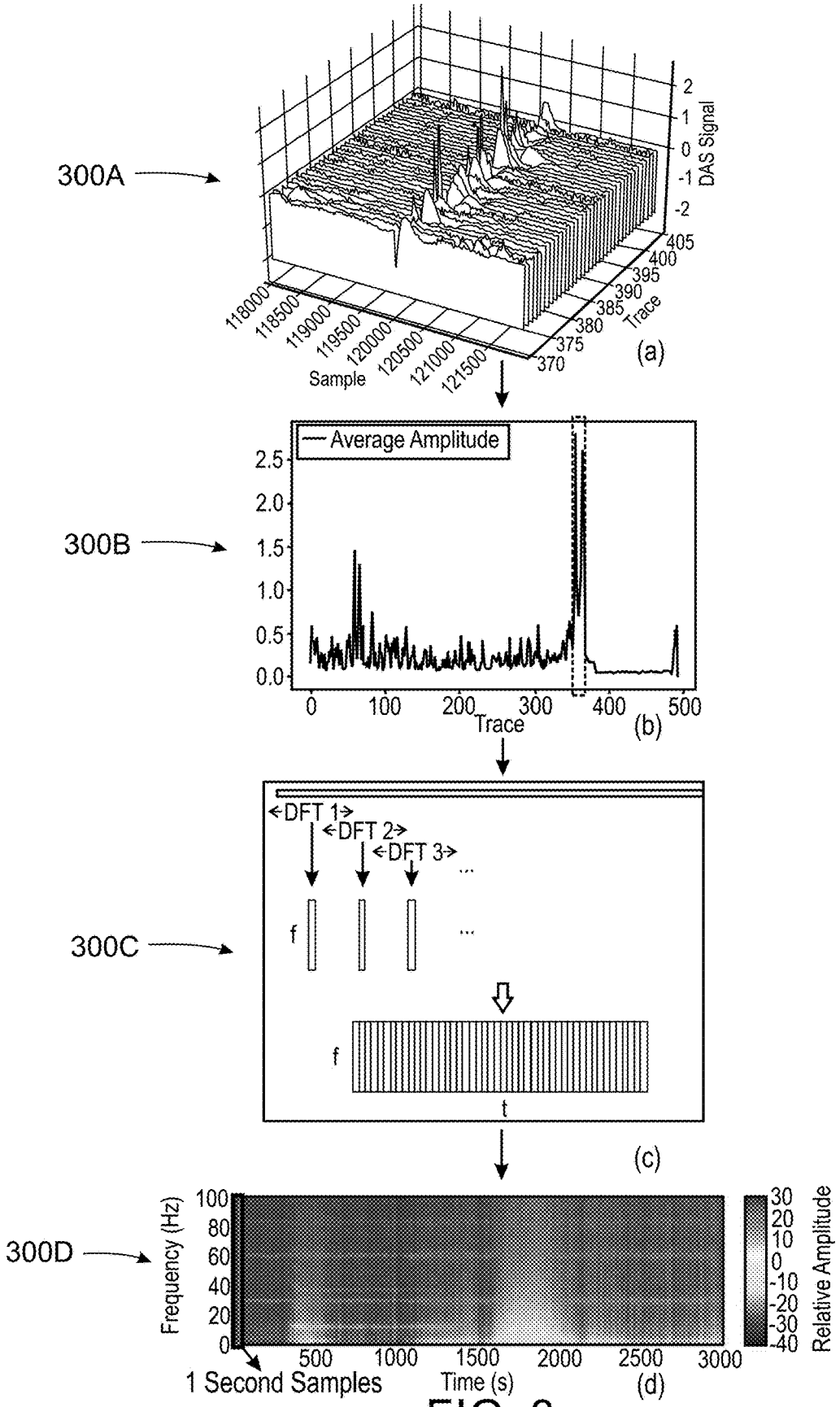
FIG. 3 example preprocessing workflow for DAS.

At data processing 104, a workflow is implemented. In examples, the workflow is based on the type of data being processed. An example preprocessing workflow is provided in FIG. 3 for DAS. The same workflow also applied to microseismic data. FIG. 3 shows a multi-trace DAS data 300A example; trace selection 300B based on the fracking induced DAS amplitude, short-time spectral analysis 300C of each DAS channel, and a partition 300D of DAS spectrogram into 1 second samples. Microseismic data follows the same preprocessing workflow.

Figure 2:
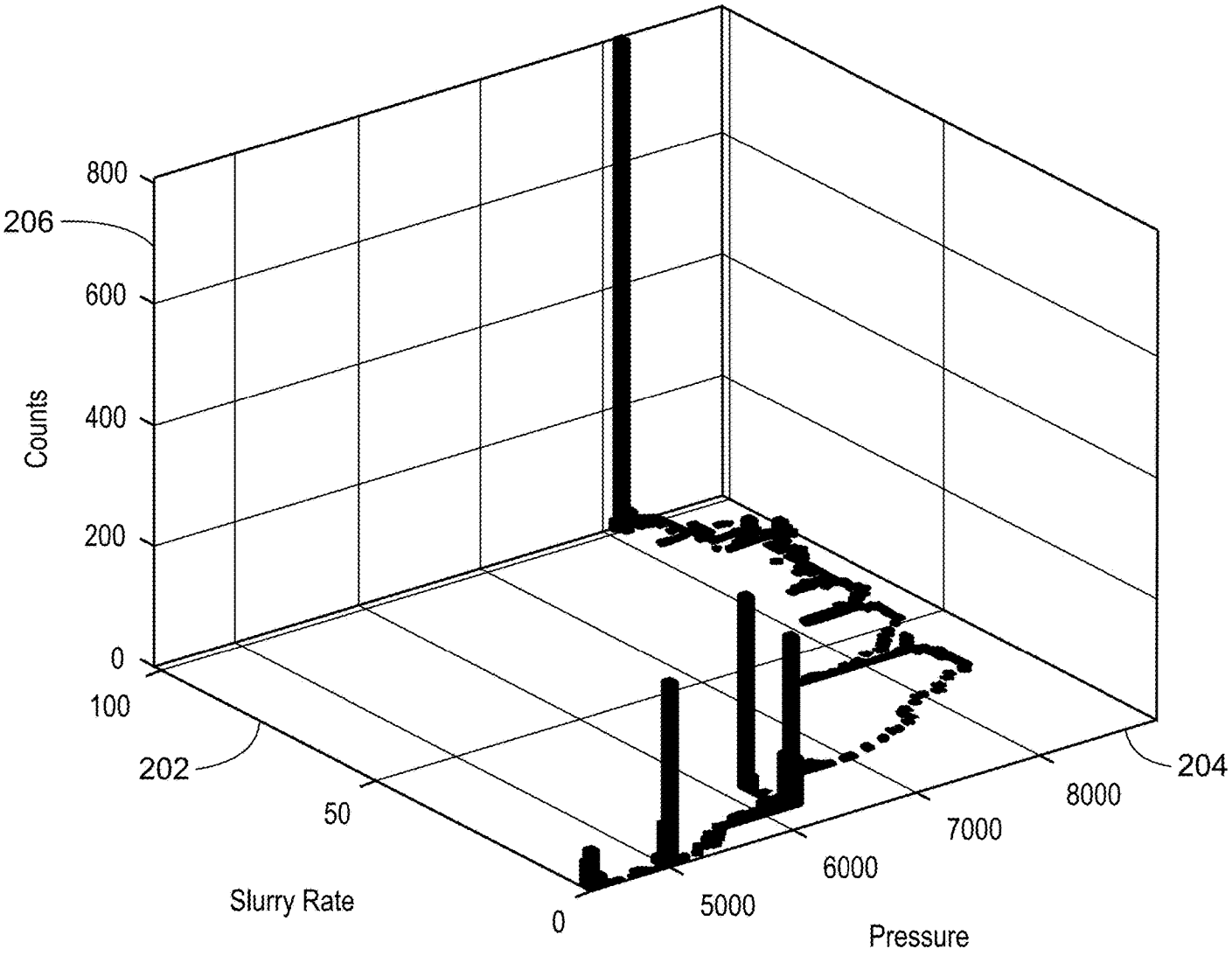
FIG. 2 is a 2D histogram of an example pumping data set

Referring again to FIG. 1, the preprocessing 104 includes data cleaning 112. Many of the input data and output variables are measured and can be either noisy, missing, or corrupted by outliers due to instrument malfunction or errors. Given that all these measurements are for physical quantities with expected value ranges, range criteria is applied to each type of data to remove out-of-range samples, after removing missing or NaN data entries via data cleaning 112. Various statistical outlier detection algorithms are applied to remove outlier samples. This is done to both the input data, as well as the output variables for training and validation purpose. A quick way to detect and visualize the data quality is via multidimensional histogram or cross plots. FIG. 2 shows an example histogram for the output variables. In particular, FIG. 2 is a two dimensional (2D) histogram of a pumping data set. In the case of outliers or samples with value way out of the bounds, that will cause the distribution to be extremely skewed.

Referring again to FIG. 1, during preprocessing 104 spectral analysis and weighted averaging 114 is shown. In examples, the plot 300C of FIG. 3 shows a short-time spectral analysis of each DAS channel. The plot 300D shows a partition of the DAS spectrogram into 1 second samples. The spectral analysis and weighted averaging 114 begins by computing the short time Fourier transform of the DAS and/or microseismic data as follows:

$$X_i(\omega, m) = DTFT(x_i(n-m)w(n))$$
$$= \sum_{n=-\infty}^{\infty} x_i(n-m)w(n)e^{-j\omega n}$$
$$= \sum_{n=-L/2}^{\frac{L}{2}} x_i(n-m)w(n)e^{-j\omega n}$$

Here (ω,) is the spectrogram of the ith channel DAS data at frequency @ and sampled at every Δ seconds for m=1, . . . . M. (n) is the window function such as the hamming window or blackman window of length L.

Take the average of the spectral signal from traces that have the strongest signal:

$$S(\omega, m) = \frac{1}{N_{DAS}} \sum_{i=bottom}^{top} S_i(\omega, m) = \frac{1}{N_{DAS}} \sum_{i=bottom}^{top} \|X_i(\omega, m)\|^2$$

Generally raw DAS data has very high sampling frequency but the most informative frequency band are under certain cutoff frequency fmax. If the frequency sampling interval is Δf, then the number of frequency samples is Nf=fmax/Δf. The resulting DAS spectrogram is of dimension Nf×M×Ndas, the averaged DAS spectrogram is of dimension Nf×M.

Figure 4:
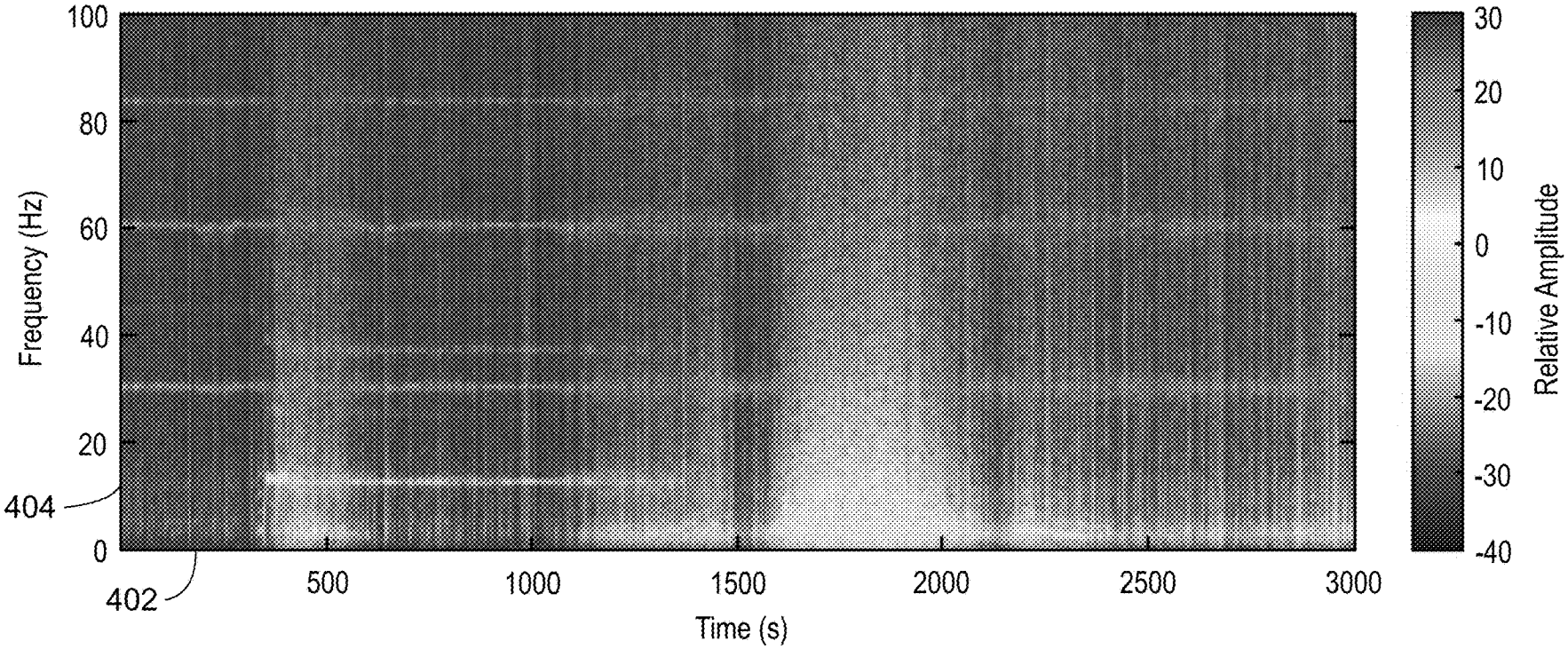
FIG. 4 is an example single channel DAS spectrogram.
Figure 6:
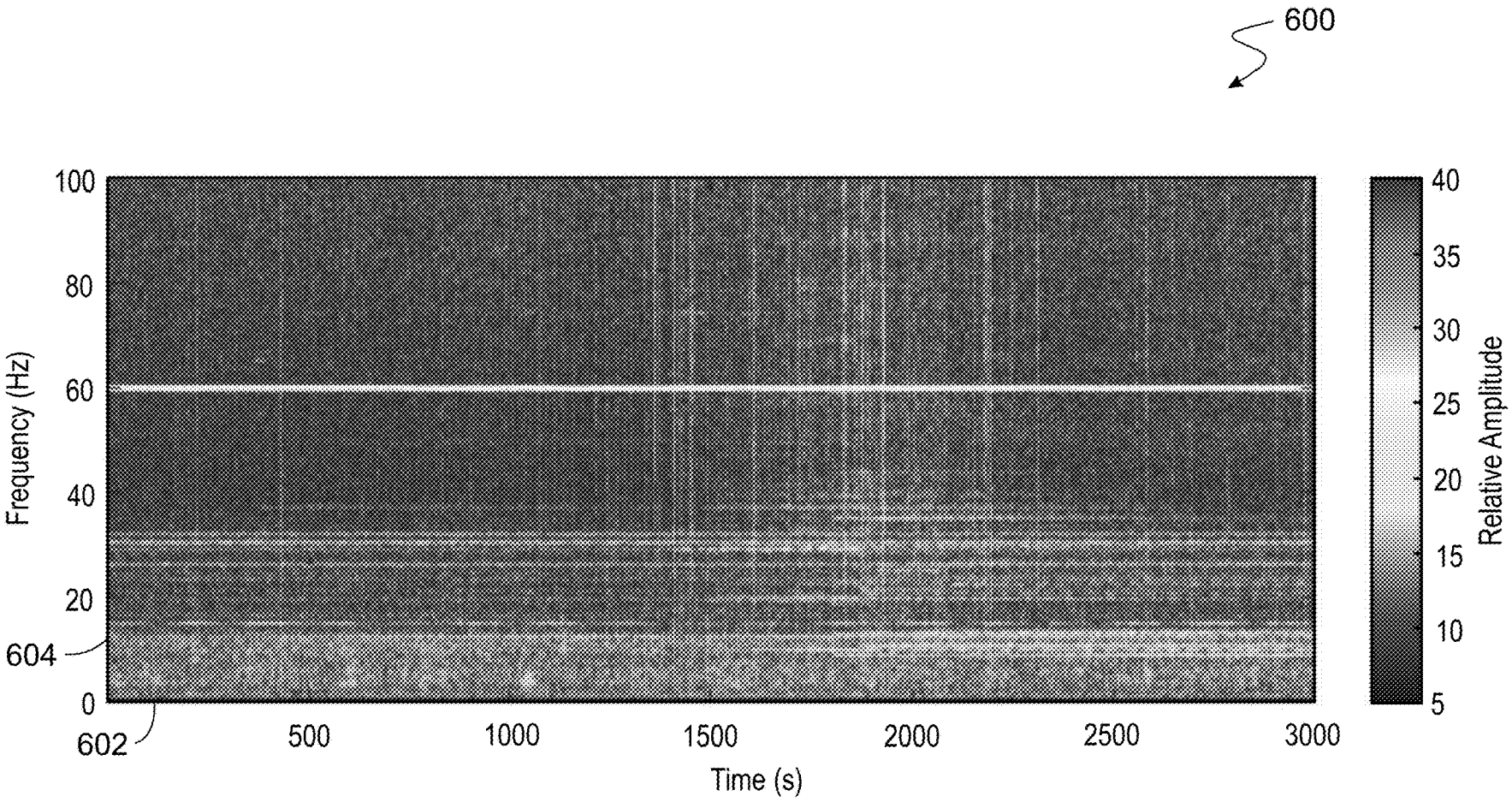
FIG. 6 is an illustration of an example single channel microseismic spectrogram.

For ease of explanation, the following Example 1 is provided. Example 1, consider a set of $N_{das}$=493 channel DAS data of duration $T_{das}$=3000s, sampled at fs,das=2 kHz, for spectrogram with a window length L=2000, time step every 10 samples or 5 ms, fmax=100 Hz, and Δf=1 Hz. In this example, spectrogram of dimension 101× (200×3000) for a single channel is determined, with a total 493 of these spectrograms. This contributes a significant amount spectral data. FIG. 4 shows an example single channel DAS spectrogram 400. In the spectrogram 400, time is plotted on the x-axis 402 and the frequency is plotted on the y-axis 404. The example of FIG. 4 shows a spectrogram 400 of microseismic data for 3000 seconds. The frequency components above 100 Hz are discarded. FIG. 6 shows an example single channel microseismic spectrogram. In the spectrogram 600, time is plotted on the x-axis 602 and the frequency is plotted on the y-axis 604. The example of FIG. 6 shows respective spectrograms of microseismic data for 3000 seconds. The frequency components above 1000 Hz are discarded.

In some embodiments, the DTS data is directly used as the network input without the Fourier transformation. For example, the DTS data in the study range is averaged along the measured depth, resulting in one dimensional (1D) vectors as the input data. The DTS data is recorded in a much lower frequency and compared to the DAS/microseismic data, so the DTS is linearly interpolated to have the same time resolution as the DAS and micro-seismic spectrograms. In examples, linear interpolation is applied to the DTS data such that is has the same number of time points as the Short-time Fourier transform (STFT) of the DAS and micro-seismic data. Then the DTS data according to the depths of chosen traces is determined, the average value computed as follows:

$$DTS_{1D}(t) = \frac{1}{N_{DTS}} \sum_{i=bottom}^{top} DTS_{1D,i}(t)$$

Figure 5:
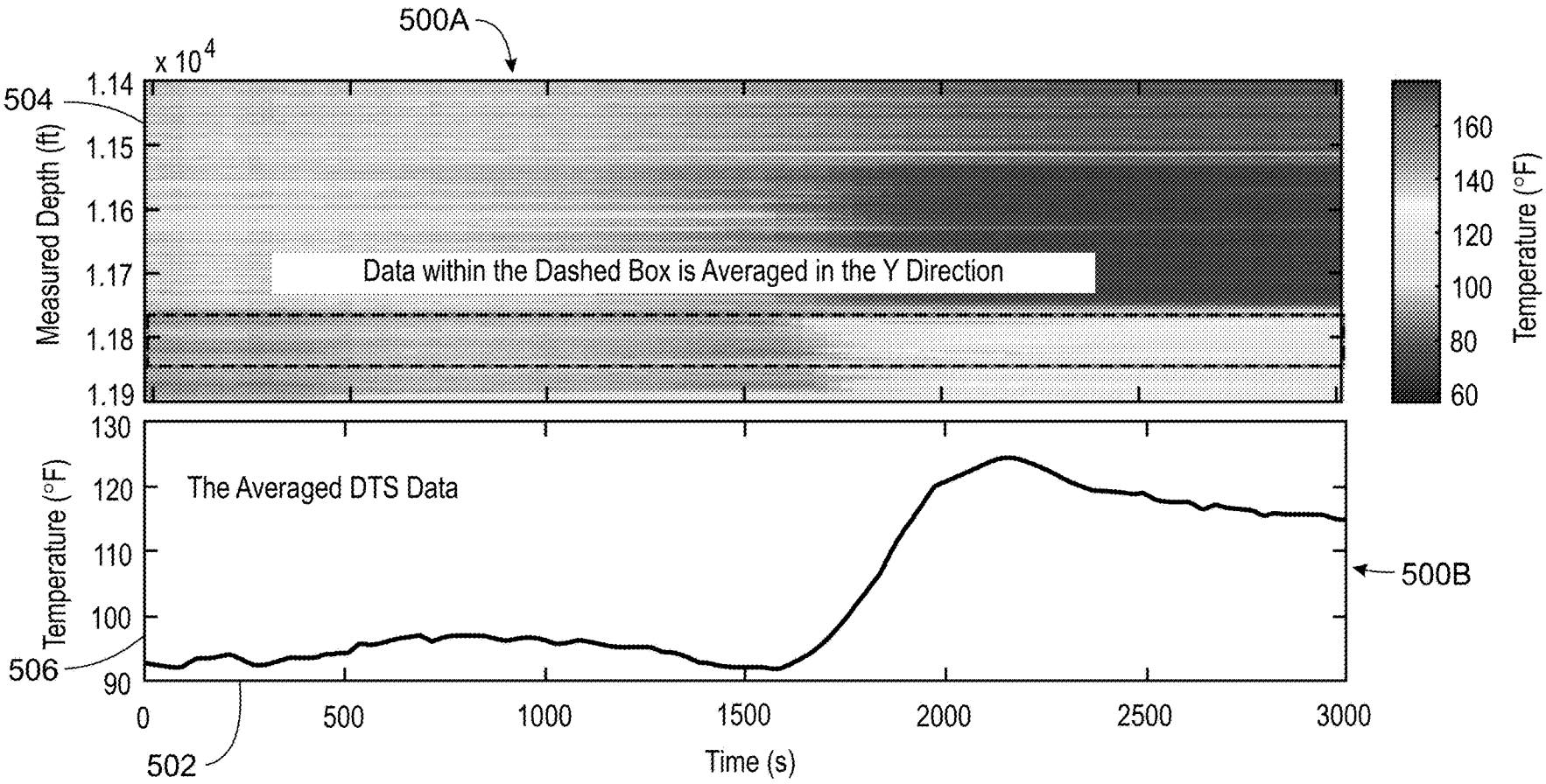
FIG. 5 is an illustration of DTS data: multichannel (vertically distributed) DTS data (top) and averaged DTS data (bottom).

FIG. 5 shows an example of multichannel DTS data 500A, as well as the averaged DTS plot 500B. In the multichannel DTS data 500A, the data is vertically distributed, with data in the y direction averaged. The x-axis 502 represents time, while the y-axis 504 represents a measured depth. In the averaged DTS plot 500B, the x-axis represents time, while the y-axis 506 represents temperature.

In embodiments, the DTS vector is expanded to 2D matrices to be consistent with the DAS and micro-seismic spectrograms. This is done by the outer product:

$$DTS_{2D}=v \otimes DTS_{1D}$$

where DTS1D∈RNt is the DTS data after the linear interpolation, $v \in R^{N}f$ is a randomly initialized vector and $N_f$ is the number of frequency points of the STFT results. After the outer product, the DTS data has size of $N_f \times N_t$. The outer product vector v will be updated during the training process.

Referring again to FIG. 1, during preprocessing 104 trace/channel selection 116 is performed. Trace/channel selection 116 locates traces most relevant to the events of interest. For example, during a specific stimulation or production stage, data recorded in the area close to the fracking location or inflow location contains the most useful information. To locate the corresponding traces, the average amplitude of the DAS signal along the time axis is calculated. Referring to FIG. 3, plots 300B and 300C show trace selection based on the fracking induced DAS amplitude and a short-time spectral analysis of each DAS channel. As shown in the example of FIG. 3, some traces have much larger amplitudes than the others. In some embodiments, for the DAS data, four traces of the larges average amplitude are fetched as the input data. The STFT of each trace is computed. For the DTS data, the data within the measured depth covered by the 4 DAS traces is fetched.

Referring again to FIG. 1, during preprocessing 104 sample data generation 118 is performed. FIG. 3 shows sample data generation at the spectrogram 300D. In some embodiments, the DAS (and microseismic as well if available) spectrograms are truncated into snapshot images of size $N_f \times N_t$ where $N_f$ is the number of frequency sample points, $N_t$ is the number of time samples. In the Example I above, taking a snapshot of length 1 second without overlap, this gives 3000 sample snapshot spectrogram images of dimension 101×200.

The DTS data, and the output data will be sampled at the same rate as the DAS and microseismic spectrograms, synchronized, before they are broken into snapshot of the same length every time step of A seconds which, after converting into images as described above, will yield sample images of the same dimension and numbers as that of DAS above.

During preprocessing 104 of FIG. 1, normalization/scaling 120 is performed. Both the inputs and outputs data are recorded at each A seconds, including pressure and slurry rate for pumping data and pressure and flow rated for production. FIG. 6 shows 3000 seconds of outputs from the stimulation stage 10. The output will be linearly normalized to [−1, 1] during the training and testing of the neural network, based on the maximum and minimum values detected from the training dataset.

During preprocessing 104 of FIG. 1, sample data partition 122 is performed. The resulting set of sample data (DAS, microseismic and DTS snapshot images) are then randomly partitioned into a training set, validation set and testing set, according to, for example, 60%, 10% and 30% ratio. In some examples, the models were trained over 60% of the samples, validated over 20% of the samples, and tested over the remaining 20% of samples. This can be done using uniform distribution in the independent identically distributed (i.i.d) sample set model where different sample snapshot images are assumed independent (for instance, in convolutional neural network (CNN) type of models), or grouped into time sequences before being randomly partitioned in Recurrent Neural Network (RNN) models.

Figure 8:
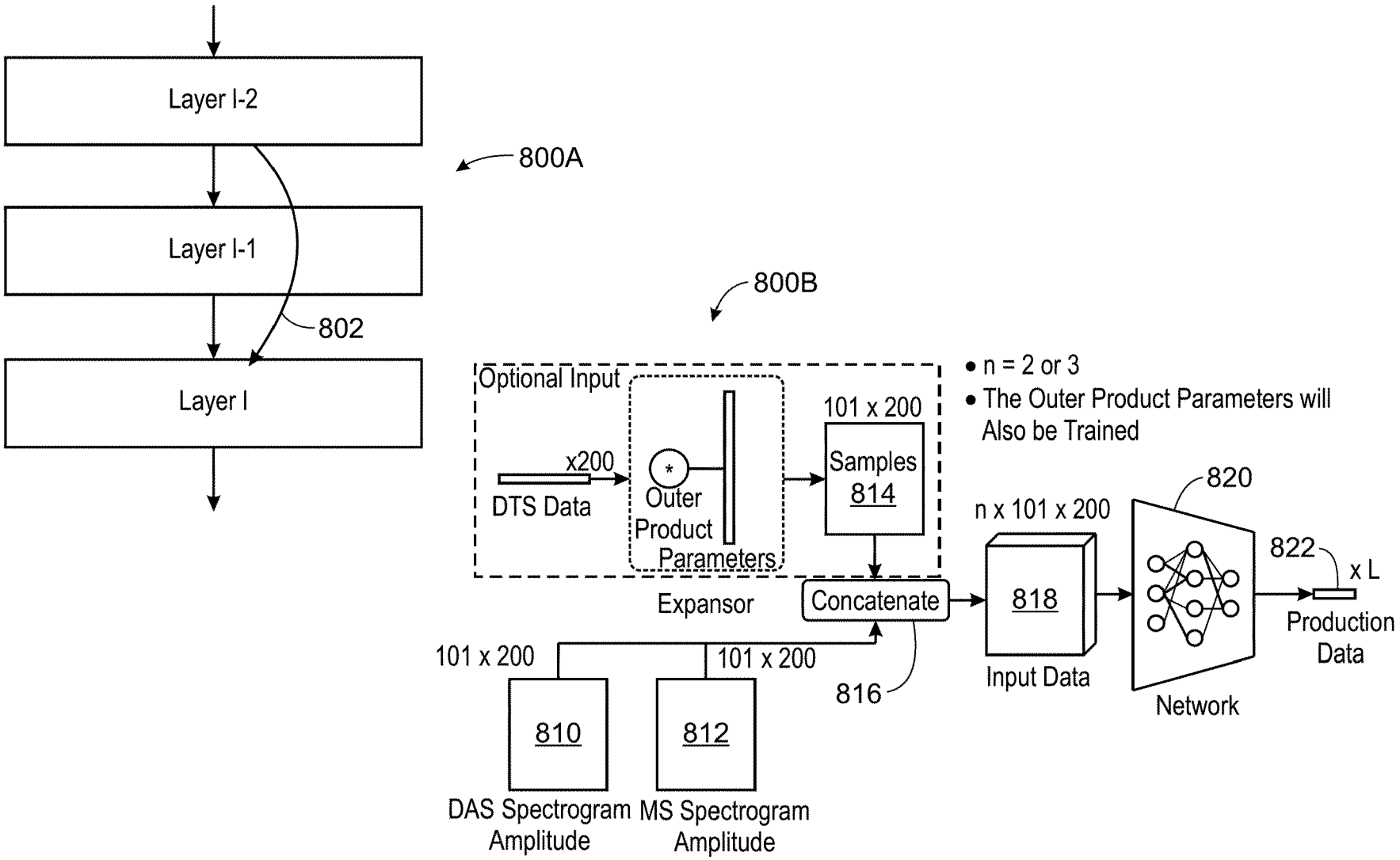
FIG. 8 is an illustration of (a) Basic structure of ResNet, (b) ResNet-18 (convolutional network) model for production data prediction from DAS, DTS and or microseismic data.
Figure 9:
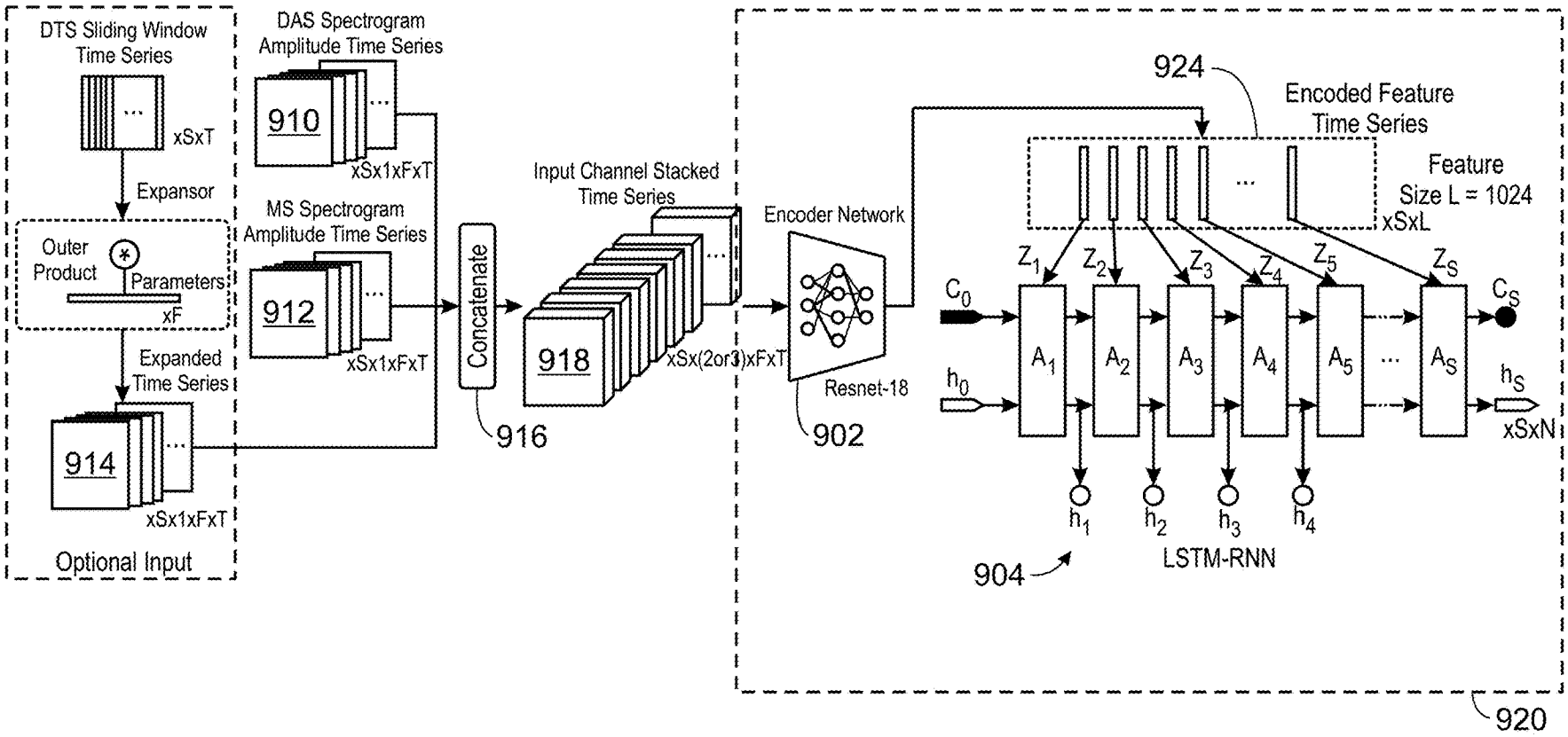
FIG. 9 is an illustration of ResNet-18 (convolutional network) plus Long short-term memory (LSTM) model for production data prediction from DAS, DTS and or microseismic data.

In the Example I above, with 60%, 10% and 30% ratio this will generate 1800 training samples, 300 validation samples, and 900 testing samples in the i.i.d. case. Data samples 106 are illustrated in FIG. 1. The data samples 106 are provided as input to machine learning models 108. In examples, the data samples 106 are preprocessed for training the machine learning models. In examples, the data samples 106 are preprocessed for input the trained machine learning models 108 for prediction of operation states and variables. In some embodiments, the machine learning models 108 are residual neural network (ResNet) models. FIG. 8 shows a ResNet deep learning neural network 800B. FIG. 9 shows a ResNet based model 902 followed by a recurrent neural network (RNN) model 904.

In examples, a ResNet is a network based on a structure called a "residual block" that uses skip connections, or shortcuts to jump over some layers, as shown by the residual block 800A. In particular, a skip connection 802 bypasses Layer I-2, directly connecting Layer I and Layer I-2. The ResNet extracts features from the input data. In examples, the ResNet-18 is a network based on a residual block with a total of eighteen layers. Multiple ResNets can be defined and used as well such as ResNet18, ResNet34, ResNet50 and etc.

In FIG. 8, a ResNet-18 model 800B is illustrated. ResNet-18 model 800B shows how the DAS data samples 810, microseismic data sample 812 and DTS data samples 814 are concatenated 816. The concatenated data samples are provided as input 818 into the ResNet network 820 before connecting to a regression layer 822 for prediction. In model 800B, the ResNet network 820 is directly connected to a regression output 822 for prediction. In this framework all samples are considered effective i.i.d.

In some embodiments, there are strong temporal dynamics in both the DAS, DTS and microseismic data as governed by the event physics (e.g. pumping, fracturing, injection or production). To explore the temporal dynamics, an RNN model is used to model sequential memories and dynamics, instead of learning the samples independently. Accordingly, in FIG. 9, DAS data samples 910, microseismic data samples 912 and DTS data samples 914 are concatenated 916. The concatenated data samples are transformed into a ResNet feature sequence 918, and provided as input to the ResNet-18+RNN network 920.

As shown in FIG. 9, ResNet-18 network 902 takes the ResNet feature sequence 918 as the input, and conducts prediction by connecting the state of the last hidden cell is connected to a fully connected layer to predict the outputs.

The whole network 920 structure is shown in FIG. 9, where the left part is the ResNet18 802 and the right part is a single-layer RNN 904. Each time a data sequence of length S is sent to the ResNet-18 902, it extract features of each sample in the data sequence, resulting in a sequence of feature vectors 924. The RNN 904 takes the sequence of feature vectors 924 as the input and predict the desired outputs. In some embodiments, the RNN 904 contains one layer based on LSTM cells. Note that in the left, the input DTS matrix is the outer product of the DTS vector and a parameter vector. The parameter vector is trained during the network training. The network can handle input of different channel numbers. Therefore, different combinations of the measurements and different ways of using multiple data traces are used. For the RNN 904, a larger sequence size will increase the memory usage while keeping the batch size. In some embodiments, the sequence size is set to be 10.

Accordingly, in an example, the ResNet+RNN model 920 includes a sequence length S=10. The number of time samples of 1 training sample is T=200. The number of frequency components under 100 Hz is set as F=101. Do is the ResNet-18 network without the output layer. A sequence of output features of ResNet-18 is the input of the LSTM-RNN. The LSTM initial state ($h_0$, $c_0$) is trained as parameters, and the last state $h_s$ of the LSTM is the prediction of the network.

In some embodiments, training the deep learning networks of FIGS. 8 and 9 includes normalizing the output data to the range of [−1, 1] based on a maximum and minimum value in the training set. Each sample output is a vector, e.g. in the pumping data case, of length 2, consisting of the values of both pressure and slurry rate. A sample data is a pair of input data (DAS, DTS and microseismic or any combination of these) and the output data (pumping pressure and rates, injection pressure and rates, or production pressure and rates). As discussed previously, the entire set of sample data are normalized, and randomly partitioned into training, validation and testing subsets.

The loss function is defined as the root mean squared error (RMSE) between the predicted output variables and the respective ground truth. The RMSE loss of the prediction:

$$L_{RMSE} = \sqrt{\frac{\sum_{i=0}^{N-1}(y_i - y_i^p)^2}{N}}$$

$y_i$ is the ground truth, yip is the network prediction. N is the number of samples in the batch. The training as well as testing performance in terms of RMSE for both models after 12 training epochs is provided in Table I. During training, various combinations of inputs were used, with and without DTS involved. Based on the pre-trained models, one could also retrain the network with different training/testing datasets.

TABLE 1

| Prediction performance of both models<br>The RMSE (of normalized data) after 12 epochs of training | | | |
|---|---|---|---|
| Dataset | | Resnet18 | Resnet18 + LSTM |
| DAS + MS | Training Set | 5.5e–4 | 1.5e–4 |
| | Test Set | 1.3e–2 | 4.8e–3 |
| DAS + DTS + MS | Training Set | 6.0e–5 | 9.3e–5 |
| | Test Set | 3.0e–3 | 1.4e–3 |

In some embodiments, there are several different workflow combinations using the deep learning models of FIGS. 8 and 9. For example, in some embodiments, the deep learning neural network model is ResNet18 as shown in FIG. 8 or ResNet18-RNN as shown in FIG. 9. In examples, the ResNet18-RNN using sequence data shown in FIG. 9 can smooth the prediction and improve the predicting accuracy. In some embodiments, the inputs provided to the deep learning models is DAS or both DAS and DTS data. For example, the present techniques can train and test the deep learning neural network with two input combinations DAS data only and DAS data+DTS data. In some embodiments, the present techniques implement averaging traces or stacking traces. For example, two different ways of processing the multi-trace data is used, averaging the traces or stacking them as multiple channels. Additionally, in some embodiments the present techniques generalize the deep learning neural network within the same stage or over different stimulation stages.

In some embodiments, the present techniques enable constrained machine learning prediction. Note that the output quantities the machine learning models are trained to predict are physical properties of the pumping, injecting or production flows, e.g. the pressure and flow rates, and they are governed by the dynamics of the flow regimes and therefore are expected to be constrained rather than completely independent from each other. This has motivated the constrained machine learning prediction where the constraints are learned among the output variables as an additional training step. The learned constraints are then enforced onto the predicted outputs so that they satisfy the learned physics constraints.

In this case the loss of the prediction network is $L_{RMSE}$. The RMSE loss of the constraint network:

$$L^{c}_{RMSE} = \sqrt{\frac{\sum_{i=0}^{N-1}(y_i - y_i^c)^2}{N}}$$

$y_i^c$ is the output from the constraint network. The final loss function becomes:

$L=L_{RMSE}+@L_{RMSE}$ a is adjusted to control the importance of the constraint network. The loss function reverse back to $L_{RMSE}$ when $\alpha=0$.

Figure 10:
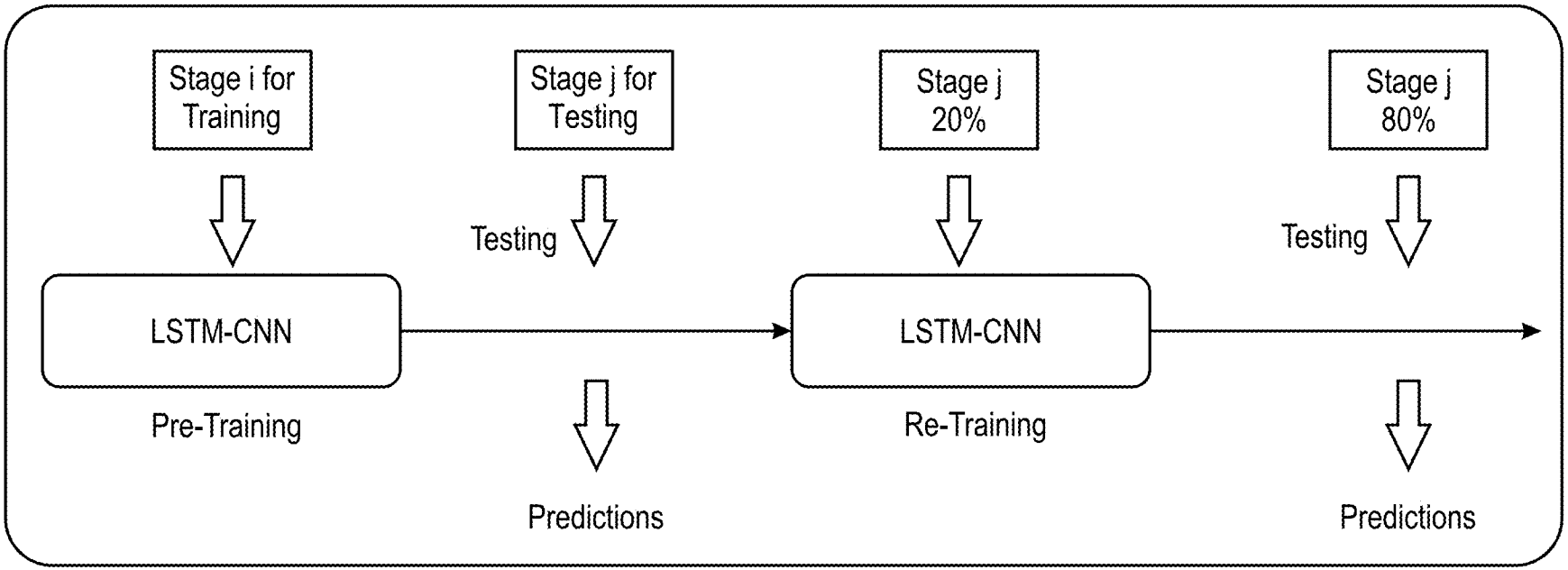
FIG. 10 is an illustration of a workflow for model training and testing over different stages.
Figure 11:
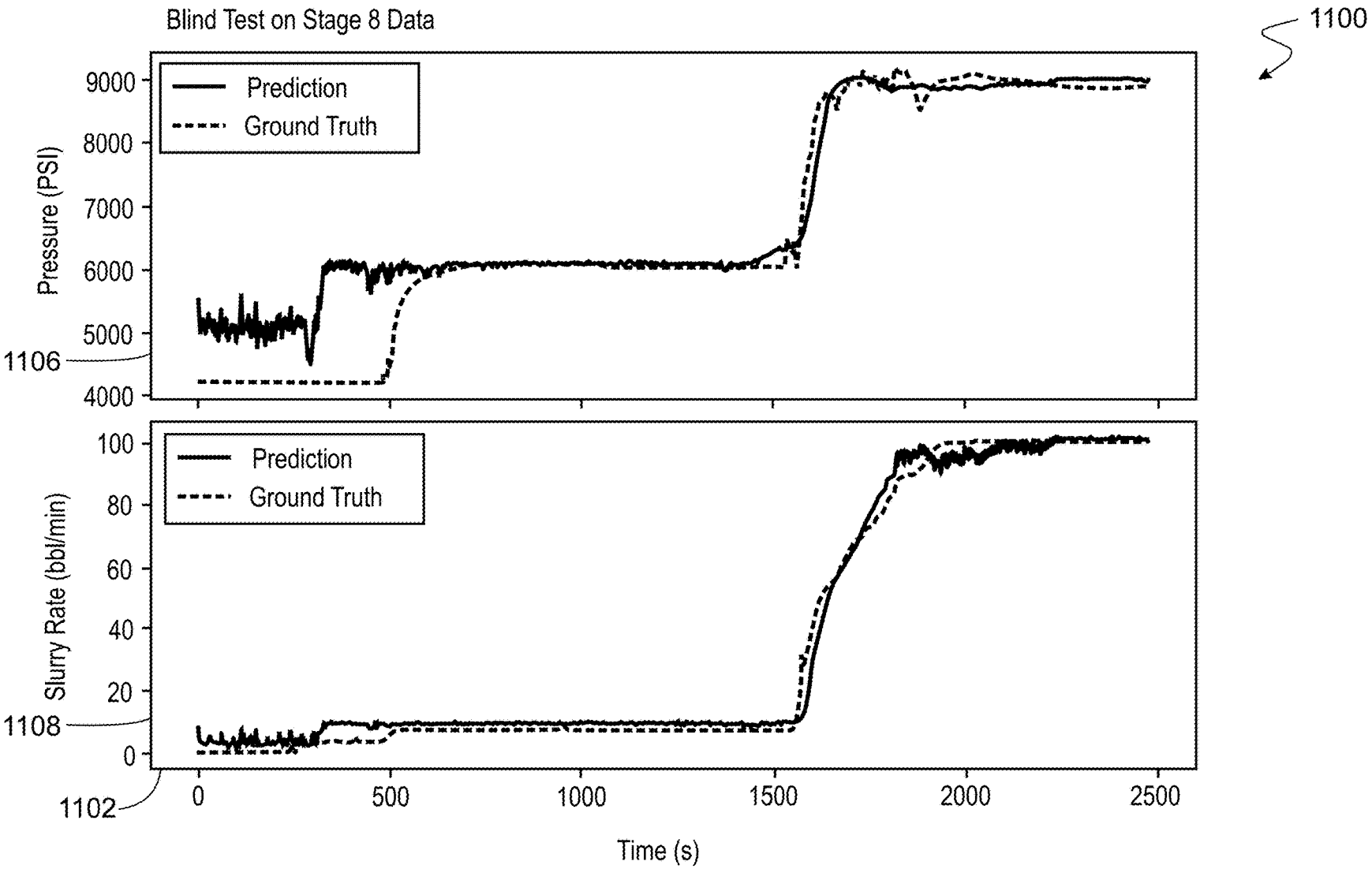
FIG. 11 is an illustration of the performance of the model pretrained on stage 9, and blind tested on stage 8.
Figure 12:
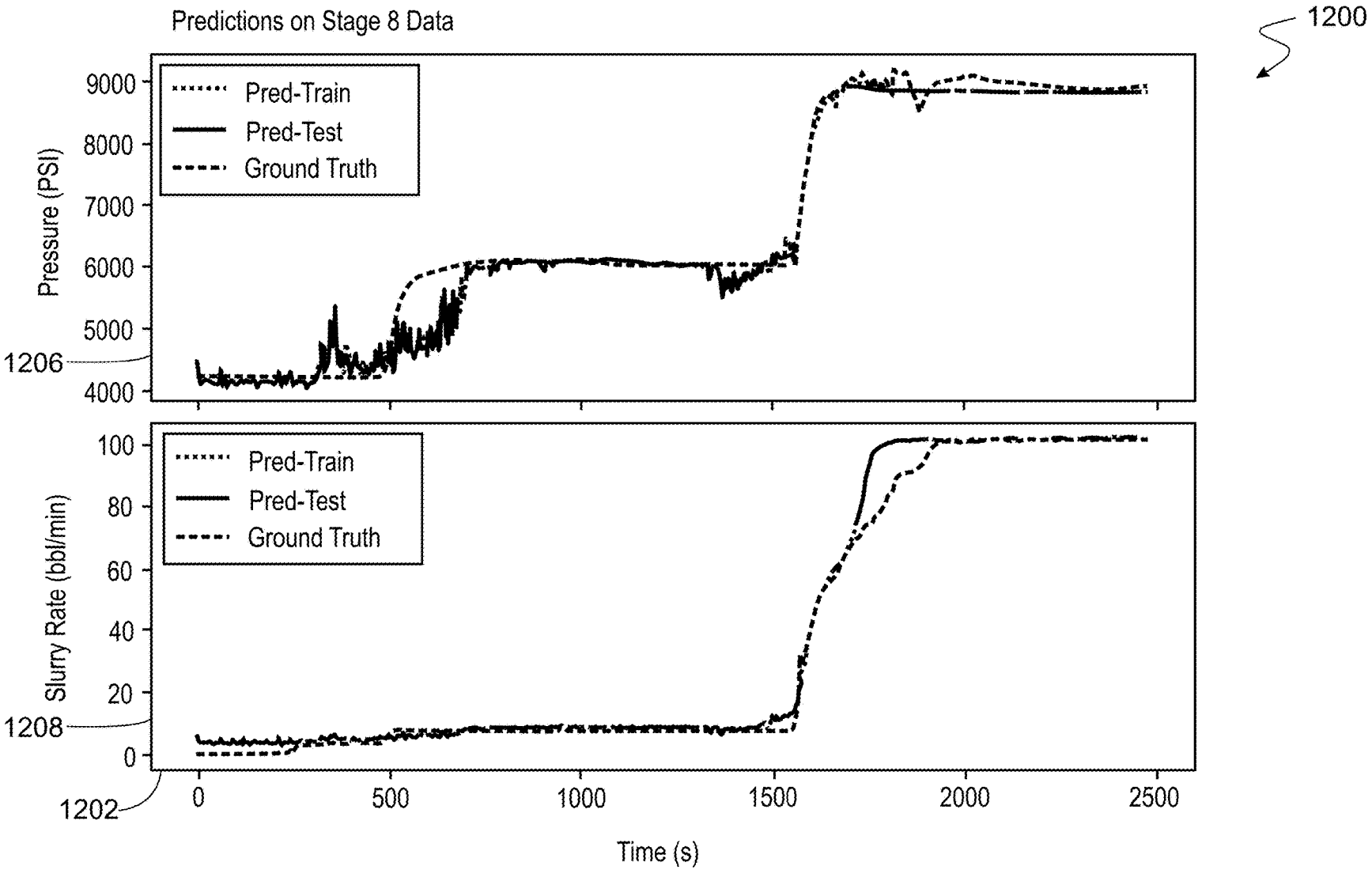
FIG. 12 is an illustration of the performance of the model pretrained on stage 9, and tested on stage 8, with 20% retraining.

In some embodiments, the deep learning neural network is tested and generalized. FIG. 10 shows a testing and generalization workflow. To evaluate the generalizability of the ResNet18-RNN network, the network is trained with data from one stimulation stage and use the trained network to predict outputs from a different stage, with and without retaining. It is essentially is a blind test without retraining. In some embodiments, 20% of the data from the testing stage is used to retrain the model. FIG. 11 shows blind test performance is given in FIG. 11, and FIG. 12 shows the prediction performance after retraining.

In some embodiments, the present techniques enable event localization. For example, for various applications, including hydraulic fracturing profiling, injection or production monitoring, it is important to be able to localize the events triggering or sustaining the measurement signals. For example, the fracking cluster locations, the production inflow distribution along the laterals, and the like. The present techniques integrate DAS, DTS and microseismic data if available, as well as the measured pressure and flow rates data, to identify and localize the events. Localizing the events determines a location, identified my coordinates, distance, or the like, of the event.

Figure 13:
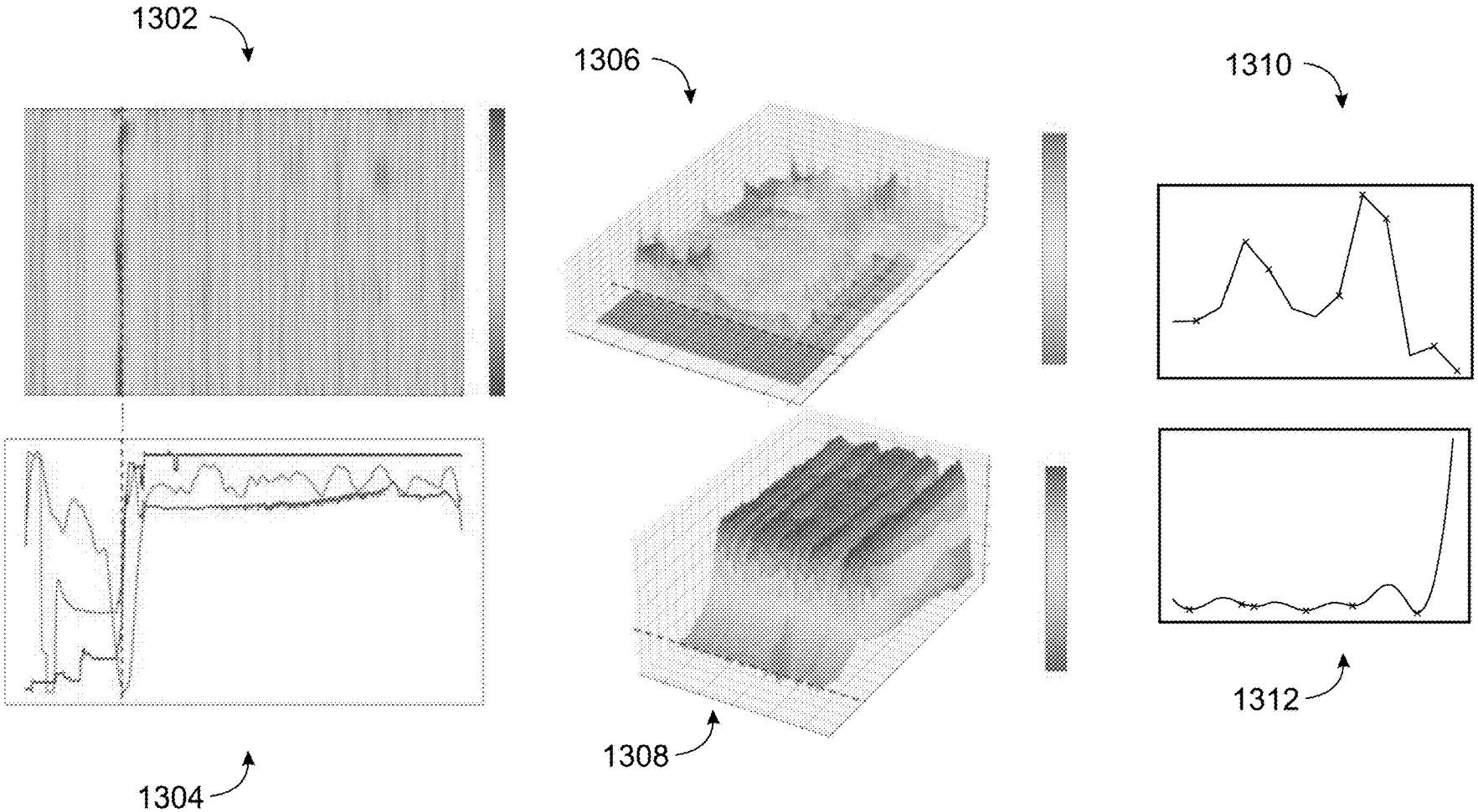
FIG. 13 is an illustration of fracking/cluster localization.

FIG. 13 shows a workflow to predict the location of clusters in a stage and the fracking events. The DTS data temporal gradients 1302 and DAS data temporal gradients 1304 are obtained and synchronized with the measured pressure and flow rates (in this case they were measured on surface). The DAS spectrogram 1306 is integrated over a given frequency band and analyzed its spatial and temporal structure as shown in FIG. 13. The spectrogram 1306 ranges from 100-1000 Hz. The negative temperature calculated from DTS is shown as a negative DTS 1308. The DAS spectrogram and negative DTS are then integrated over time to generate respective depth profiles 1310 and 1312, which can then be used to pick the event locations (e.g., cluster locations). In this manner, machine learning based methods are used to quantitatively predicting hydraulic fracturing profiling from fiber optic DAS data, DTS data, microseismic data, or any combination of these data. The associated events are identified and localized.

Figure 14:
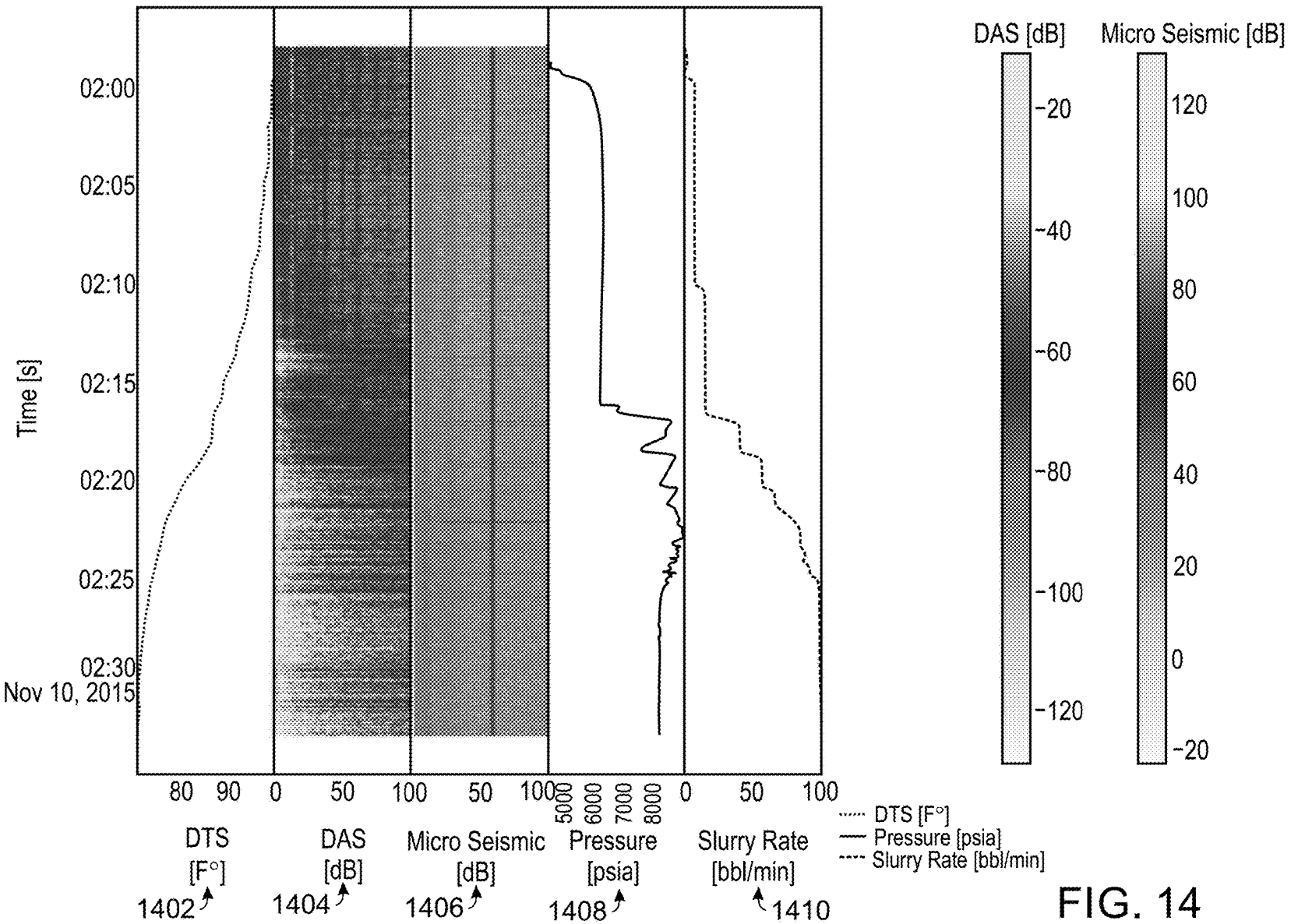
FIG. 14 is an illustration of a DAS/DTS/microseismic data synced with pressure and slurry rate data for one example stage. DAS and microseismic data are plotted in spectrogram for one channel each

In some examples, DAS data, DTS data, and microseismic data measured during the actual hydraulic fracturing pump phases is obtained, and the pump data (e.g., pressure and slurry rate) directly predicted from the DAS/DTS and microseismic measurements over the monitored stages. In some embodiments, microseismic data is optional. FIG. 14 shows an example plot of these data in single channel time (DTS 1402, pressure 1408 and slurry rates 1410) or time-spectral domain (DAS 1404 and microseismic 1406). FIG. 14 is an illustration of the DAS/DTS/microseismic data synced with pressure and slurry rate data for one example stage. DAS and microseismic data are plotted in spectrogram for one channel each.

Figure 15:
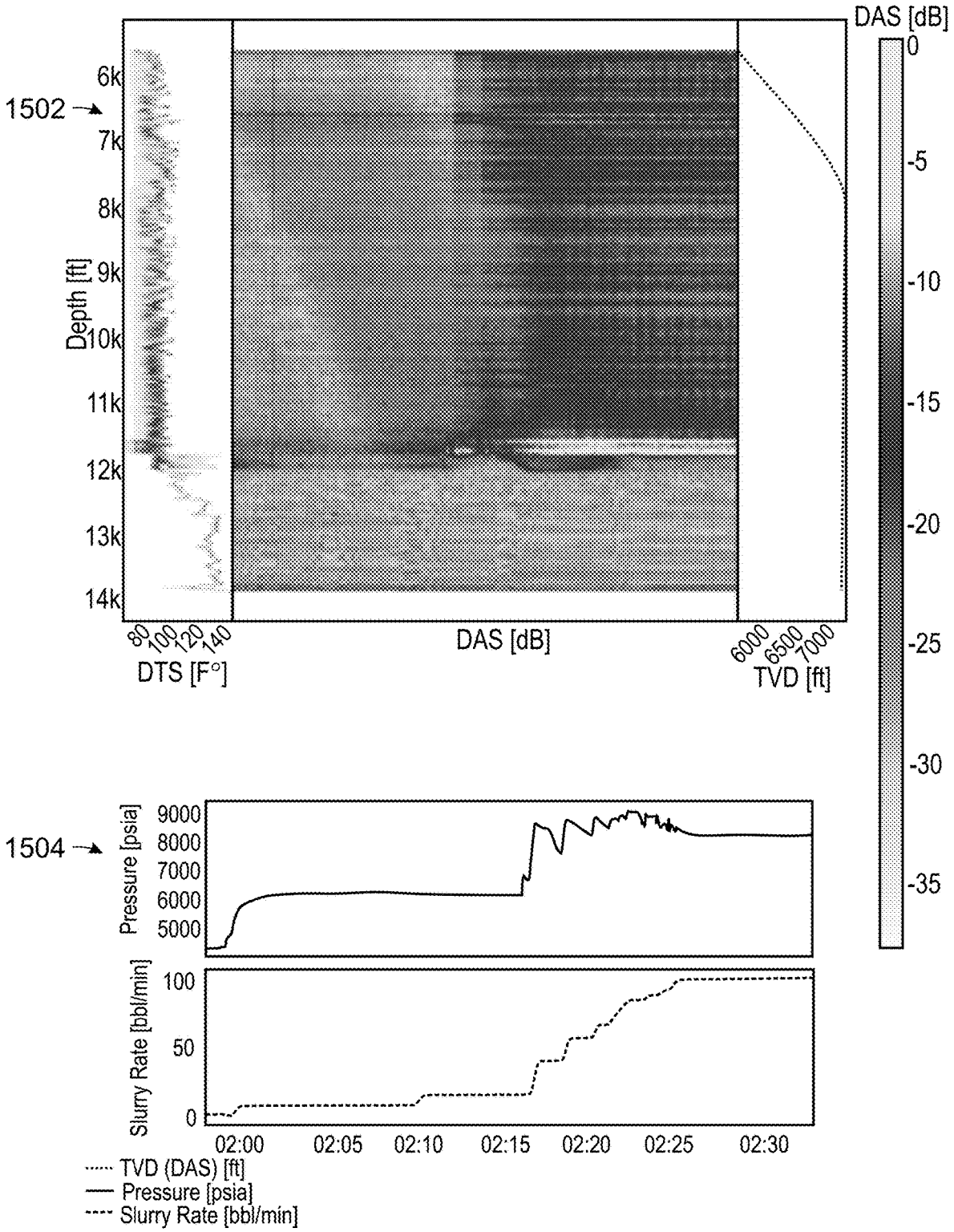
FIG. 15 is an illustration of the DAS frequency band extracted data over the well depth synced with pressure and slurry rate data for one example stage.

FIG. 15 shows the averaged DTS 1504 and the DAS FBE 1502 over the entire well depth synced in time with the pressure and slurry rates. The deep learning approach described herein includes inputs to the deep neural network model as the DAS/DTS and microseismic data, and the outputs the pumping pressure and slurry rates at each respective stage, as shown in FIG. 1. The overall approach is to train the deep neural network models to map the input DAS/DTS and the optional microseismic measurements into the pressure and rate values over the same time period, so that the prediction is as close as possible to the actual measured pressure and rates. Once trained, the models are then applied to the testing data within the same stage or to different stages as blind test. In some embodiments, the developed model and the training/testing procedure are extended to predict production data from DAS/DTS measurements. The benefit of choosing to work on pumping data are two folds: a. relatively accurate measurements of these data on the surface are known, therefore the labels can be expected to have high quality; b. the hydraulic fracturing process hence the pumping data have relatively short time span compared with production data and therefore the training process has relatively lower complexity and can be done in reasonably short time.

Specifically, the DAS/DTS/microseismic measurements and pumping data are collected from a large number of hydraulic fracture stages together, before randomly partitioning the samples into the training, the validation and the testing subsets. The training and validation sets are used to fit the deep learning models before they are applied to the testing set for performance evaluation.

The DAS and microseismic data are converted into spectral domain segmented over time. As shown in FIG. 8 and FIG. 9, two types of deep learning models are used according to the present techniques: I) A ResNet network, which maps time snapshots of these measurement samples to the synced pump data independently; and II) a convolutional LSTM sequence learning model maps time segments of these measurement samples into the synced pump data. Both models were trained over a randomly partitioned subset of samples before applied to the remaining testing samples.

Figure 16:
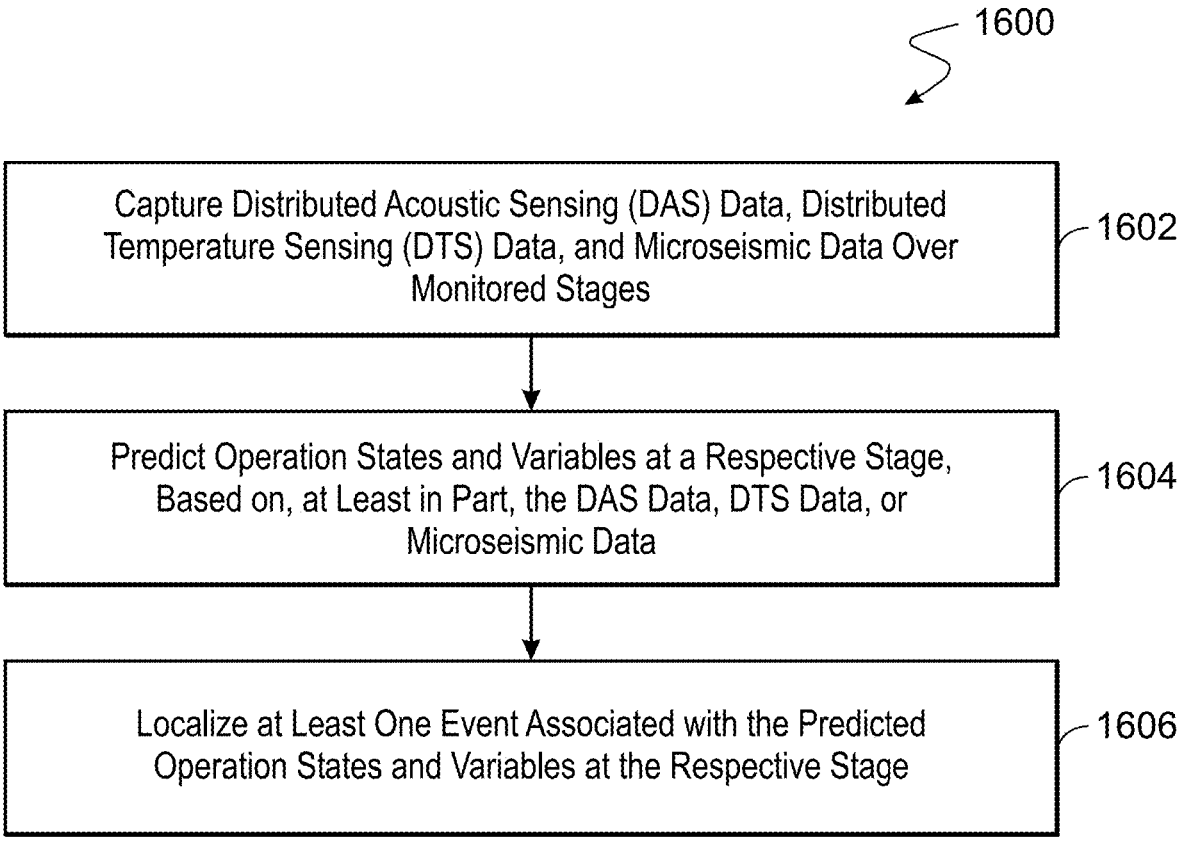
FIG. 16 is a process flow diagram of a process for quantitative hydraulic fracturing surveillance from fiber optic sensing using machine learning.

FIG. 16 is a process flow diagram of a process for quantitative hydraulic fracturing surveillance from fiber optic sensing using machine learning.

At block 1602, distributed acoustic sensing (DAS) data, distributed temperature sensing (DTS) data, and microseismic data is captured over monitored stages. At block 1604, operation states and variables are predicted at a respective stage, based on, at least in part, the DAS data, DTS data, or microseismic data. At block 1606, at least one event associated with the predicted operation states and variables at the respective stage is localized. In some embodiments, the predictions are made using machine learning models. Deep learning based models and algorithms are deployed to directly predict pressure and slurry rates during hydraulic fracturing process from measured fiber-optic sensing data sets, including DAS, DTS and optically microseismic data. The deep learning models provide accurate and reliable prediction of these operation variables. When combined with efficient preprocessing of the large volume of fiber optic DAS/DTS data. This will enable and provide the first step towards an automated quantitative framework for intelligence completion and production monitoring, with minimal manual interpretation.

Figure 17:
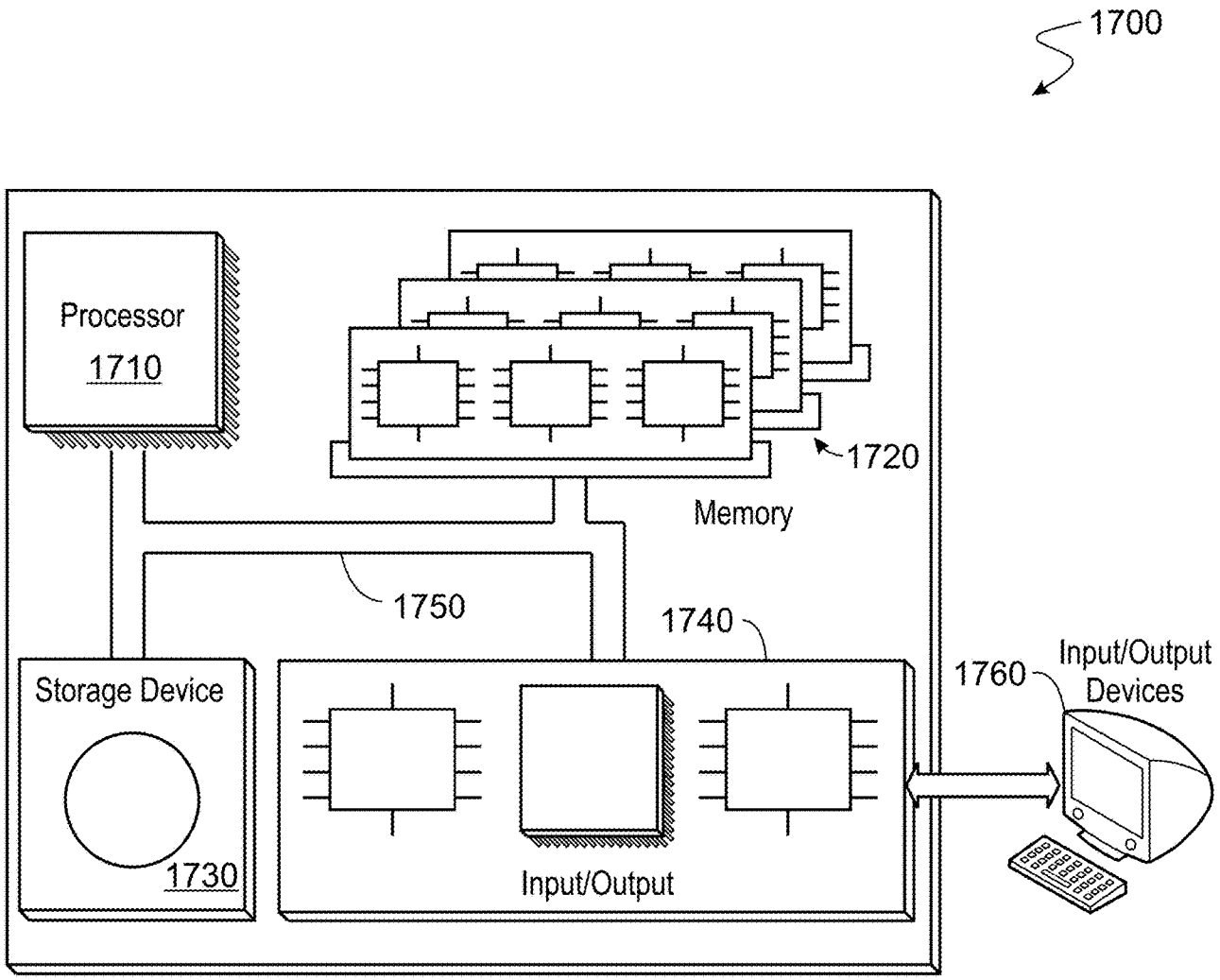
FIG. 17 is a schematic illustration of an example controller (or control system) for quantitative hydraulic fracturing surveillance from fiber optic sensing using machine learning according to the present disclosure.

FIG. 17 is a schematic illustration of an example controller 1700 (or control system) for quantitative hydraulic fracturing surveillance from fiber optic sensing using machine learning according to the present disclosure. For example, the controller 1700 may include or be part of the system of FIG. 1, the process of FIG. 16, and the like. The controller 1700 is intended to include various forms of digital computers, such as printed circuit boards (PCB), processors, digital circuitry, or otherwise parts of a system for supply chain alert management. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 1700 includes a processor 1710, a memory 1720, a storage device 1730, and an input/output interface 1740 communicatively coupled with input/output devices 1760 (e.g., displays, keyboards, measurement devices, sensors, valves, pumps). Each of the components 1710, 1720, 1730, and 1740 are interconnected using a system bus 1750. The processor 1710 is capable of processing instructions for execution within the controller 1700. The processor may be designed using any of a number of architectures. For example, the processor 1710 may be a CISC (Complex Instruction Set Computers) processor, a RISC (Reduced Instruction Set Computer) processor, or a MISC (Minimal Instruction Set Computer) processor.

In one implementation, the processor 1710 is a single-threaded processor. In another implementation, the processor 1710 is a multi-threaded processor. The processor 1710 is capable of processing instructions stored in the memory 1720 or on the storage device 1730 to display graphical information for a user interface on the input/output interface 1740.

The memory 1720 stores information within the controller 1700. In one implementation, the memory 1720 is a computer-readable medium. In one implementation, the memory 1720 is a volatile memory unit. In another implementation, the memory 1720 is a nonvolatile memory unit.

The storage device 1730 is capable of providing mass storage for the controller 1700. In one implementation, the storage device 1730 is a computer-readable medium. In various different implementations, the storage device 1730 may be a floppy disk device, a hard disk device, an optical disk device, or a tape device.

The input/output interface 1740 provides input/output operations for the controller 1700. In one implementation, the input/output devices 1760 includes a keyboard and/or pointing device. In another implementation, the input/output devices 1760 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

Other implementations are also within the scope of the following claims.

What is claimed is:

1. A computer-implemented method for quantitative hydraulic fracturing surveillance from fiber optic sensing using machine learning, the method comprising:

capturing, with one or more hardware processors, distributed acoustic sensing (DAS) data, distributed temperature sensing (DTS) data, and microseismic data over monitored stages;

predicting, with the one or more hardware processors, operation states and variables at a respective stage, based on, at least in part, the DAS data, DTS data, or microseismic data, wherein the variables comprise pumping variables, production flow pressure and rates, and fracking cluster locations; and localizing, with the one or more hardware processors, at least one event associated with the predicted operation states and variables at the respective stage.

2. The computer-implemented method of claim 1, wherein the monitored stages are perforation and actual hydraulic fracturing pump phases.

3. The computer-implemented method of claim 1, wherein localizing the at least one event comprises determining a location of the event.

4. The computer-implemented method of claim 1, wherein the capturing, predicting, and localizing are performed in situ and in real time.

5. The computer-implemented method of claim 1, wherein the variables comprise slurry rates or pressures formulated from the DAS data, DTS data, and microseismic data over the monitored stages.

6. The computer-implemented method of claim 1, wherein the monitored stages occur over different well depth ranges.

7. An apparatus comprising a non-transitory, computer readable, storage medium that stores instructions that, when executed by at least one processor, cause the at least one processor to perform operations comprising:

capturing distributed acoustic sensing (DAS) data, distributed temperature sensing (DTS) data, and microseismic data over monitored stages;

predicting operation states and variables at a respective stage, based on, at least in part, the DAS data, DTS data, or microseismic data, wherein the variables comprise pumping variables, production flow pressure and rates, and fracking cluster locations; and localizing at least one event associated with the predicted operation states and variables at the respective stage.

8. The apparatus of claim 7, wherein the monitored stages are perforation and actual hydraulic fracturing pump phases.

9. The apparatus of claim 7, wherein localizing the at least one event comprises determining a location of the event.

10. The apparatus of claim 7, wherein the capturing, predicting, and localizing are performed in situ and in real time.

11. The apparatus of claim 7, wherein the variables comprise slurry rates or pressures formulated from DAS data, DTS data, and microseismic data over the monitored stages.

12. The apparatus of claim 7, wherein the monitored stages occur over different well depth ranges.

13. A system, comprising:

one or more memory modules;

one or more hardware processors communicably coupled to the one or more memory modules, the one or more hardware processors configured to execute instructions stored on the one or more memory models to perform operations comprising:

capturing distributed acoustic sensing (DAS) data, distributed temperature sensing (DTS) data, and microseismic data over monitored stages;

predicting operation states and variables at a respective stage, based on, at least in part, the DAS data, DTS data, or microseismic data, wherein the variables comprise pumping variables, production flow pressure and rates, and fracking cluster locations; and localizing at least one event associated with the predicted operation states and variables at the respective stage.

14. The system of claim 13, wherein the monitored stages are perforation and actual hydraulic fracturing pump phases.

15. The system of claim 13, wherein localizing the at least one event comprises determining a location of the event.

16. The system of claim 13, wherein the capturing, predicting, and localizing are performed in situ and in real time.

17. The system of claim 13, wherein the variables comprise slurry rates or pressures formulated from DAS data, DTS data, and microseismic data over the monitored stages.

* * * * *